US007667448B2

(12) United States Patent
Matsumoto et al.

(10) Patent No.: US 7,667,448 B2
(45) Date of Patent: Feb. 23, 2010

(54) REFERENCE VOLTAGE GENERATION CIRCUIT

(75) Inventors: Akinori Matsumoto, Osaka (JP); Shiro Sakiyama, Kyoto (JP); Takashi Morie, Osaka (JP)

(73) Assignee: Panasonic Corporation, Osaka (JP)

( * ) Notice: Subject to any disclaimer, the term of this patent is extended or adjusted under 35 U.S.C. 154(b) by 384 days.

(21) Appl. No.: 11/783,800

(22) Filed: Apr. 12, 2007

(65) Prior Publication Data

US 2008/0007243 A1 Jan. 10, 2008

(30) Foreign Application Priority Data

Jul. 7, 2006 (JP) ..... 2006-188348

(51) Int. Cl.
*G05F 3/04* (2006.01)

(52) U.S. Cl. ..... 323/312

(58) Field of Classification Search ..... 323/312, 323/313, 314, 315, 316

See application file for complete search history.

(56) References Cited

U.S. PATENT DOCUMENTS

| | | | | |
|---|---|---|---|---|
| 6,489,835 | B1 * | 12/2002 | Yu et al. | 327/539 |
| 7,005,839 | B2 * | 2/2006 | Wada | 323/316 |
| 2007/0069709 | A1 * | 3/2007 | Jeong et al. | 323/312 |

FOREIGN PATENT DOCUMENTS

| | | |
|---|---|---|
| JP | 10-198447 | 7/1998 |

* cited by examiner

*Primary Examiner*—Adolf Berhane
(74) *Attorney, Agent, or Firm*—McDermott Will & Emery LLP

(57) ABSTRACT

A reference voltage generation circuit of the present invention includes: a band gap reference-type current generation circuit for controlling each of currents flowing through a first current path and a second current path, which are extending from a first node to a second node, to be a predetermined reference current, by utilizing a voltage difference occurring between a pair of transistors or diodes; and a resistive load circuit provided between the second node and a third node.

32 Claims, 18 Drawing Sheets

REFERENCE VOLTAGE GENERATION CIRCUIT

CROSS REFERENCE TO RELATED APPLICATION

This application claims priority under 35 U.S.C. §119 on Patent Application No. 2006-188348 filed in Japan on Jul. 7, 2006, the entire contents of which are hereby incorporated by reference.

BACKGROUND OF THE INVENTION

1. Field of the Invention

The present invention relates to a band gap reference-type reference voltage generation circuit for use in portable systems, battery-powered systems, integrated circuits provided therein, etc.

2. Description of the Background Art

A reference voltage generation circuit including a band gap reference circuit (referred also as a "BGR circuit") is typically used in various analog circuits provided in semiconductor devices in order to suppress variations in the overall characteristics of the circuits due to variations in the power supply voltage and the temperature. A reference voltage obtained by means of such a BGR-type reference voltage generation circuit is known to be little dependent on the power supply voltage or the temperature.

An example of a known reference voltage generation circuit including a BGR-type reference voltage generation circuit is the reference voltage generation circuit shown in FIG. 5 of Japanese Laid-Open Patent Publication No. 10-198447 (Patent Document 1). The reference voltage generation circuit includes PMOS transistors P1, P2 and P3, NMOS transistors N1 and N2, a diode D1, and resistors R1 and R2. In the reference voltage generation circuit having such a configuration, a current according to the gate-source voltage of the NMOS transistors N1 and N2 flows through the first current path including the PMOS transistor P1, the second current path including the PMOS transistor P2, and the third current path including the resistive element R2 and the diode D1.

In the paragraphs mentioned above, Patent Document 1 describes that the output voltage (reference voltage) Vref is as expressed in the expression below, where the PMOS transistors P1, P2 and P3 are of the same transistor size, and the transistor size ratio between the NMOS transistors N1 and N2 is 1:M.

$$V_{ref} = N \cdot \left(k \cdot \frac{T}{q}\right) \cdot \ln M + VF(D1)$$

In the expression, N denotes (Resistance value of R2)/(Resistance value of R1), q the charge of electron, k the Boltzmann constant, T the absolute temperature, VF(D1) the forward voltage of D1.

SUMMARY OF THE INVENTION

However, in the reference voltage generation circuit shown in FIG. 5 of Patent Document 1, a current flows not only through the first and second current paths but also through the third current path including the resistive element R2 and the diode D1, thus resulting in a large power consumption.

With the provision of the PMOS transistor P3 for conducting, through the third current path, a current being a multiple of those flowing though the first current path and the second current path by a predetermined factor, there are a large number of elements and the chip area is large.

Moreover, because of the influence of the relative variations due to the process condition of the threshold voltage of the PMOS transistor P3, the ratio between the current actually flowing through the first current path and that through the third current path is shifted from the desired current ratio, thus resulting in substantial fluctuations in the output voltage Vref.

For an electric device including a large-scale integrated circuit therein, the two most important problems are to reduce the power consumption and to reduce the cost. In order to reduce the cost of such an electric device, it is important to reduce the circuit area of the large-scale integrated circuit therein.

It is therefore an object of the present invention to provide a reference voltage generation circuit capable of generating a precise, stable voltage, with a low current consumption and a small area.

In order to achieve the object set forth above, a first reference voltage generation circuit of the present invention includes:

a current mirror circuit including a first current mirror MOS transistor provided along a first current path extending from a first node to a second node, and a second current mirror MOS transistor for conducting, through a second current path extending from the first node to the second node, a current being a multiple of that flowing through the first current path; and a reference current generation circuit including a first reference current MOS transistor or a first reference current diode provided along the first current path and a second reference current MOS transistor or a second reference current diode provided along the second current path, whereby each of currents flowing through the first and second current paths is a constant reference current according to a gate-source voltage difference occurring in the first and second reference current MOS transistors or an anode-cathode voltage difference occurring in the first and second reference current diodes, wherein:

a source of at least one of the first and second current mirror MOS transistors and the first and second reference current MOS transistors is connected to the second node;

a resistive load circuit including a load section MOS transistor whose source is connected to the second node and whose gate and drain are connected to each other, and a resistive element connected between the drain of the load section MOS transistor and a third node; and a reference voltage output stage for outputting a voltage at an output node as a reference voltage, including a first output stage MOS transistor and a second output stage MOS transistor, wherein the first output stage MOS transistor has a drain connected to the first node, a source connected to the output node, and a gate connected to the gate of the MOS transistor whose source is connected to the second node, and the second output stage MOS transistor has a source connected to the output node, a drain connected to the third node, and a gate connected to the gate of the load section MOS transistor.

With the above voltage generation circuit, the current flow through the first current path and that through the second current path merge together and flow into the resistive load circuit, whereby it is possible to obtain a reference voltage with a higher precision. With the provision of the reference voltage output stage, it is possible to obtain the reference voltage with a lower output impedance.

A second reference voltage generation circuit of the present invention is the first reference voltage generation circuit, wherein:

the reference current generation circuit further includes a resistive element a first end of which is connected to a first one of the first and second nodes;

the first reference current MOS transistor is a transistor whose source is connected to a second end of the resistive element;

the second reference current MOS transistor is a transistor whose source is connected to the first one of the first and second nodes and whose gate and drain are connected to each other and to a gate of the first reference current MOS transistor;

the first current mirror MOS transistor is a transistor whose drain and gate are connected to each other, to a drain of the first reference current MOS transistor and to a gate of the second current mirror MOS transistor, and whose source is connected to a second one of the first and second nodes;

the second current mirror MOS transistor is a transistor whose drain is connected to the drain of the second reference current MOS transistor, and whose source is connected to the second one of the first and second nodes; and the first one of the first and second nodes is of a higher potential than the second one of the first and second nodes;

the first and second reference current MOS transistors are each a PMOS transistor;

the first and second current mirror MOS transistors are each an NMOS transistor;

or the first one of the first and second nodes is of a lower potential than the second one of the first and second nodes;

the first and second reference current MOS transistors are each an NMOS transistor; and the first and second current mirror MOS transistors are each a PMOS transistor.

A third reference voltage generation circuit of the present invention is the second reference voltage generation circuit, wherein:

the first node is of a higher potential than the third node;

the load section MOS transistor is a PMOS transistor;

the first output stage MOS transistor is an NMOS transistor; and the second output stage MOS transistor is a PMOS transistor;

or the first node is of a lower potential than the third node;

the load section MOS transistor is an NMOS transistor;

the first output stage MOS transistor is a PMOS transistor; and the second output stage MOS transistor is an NMOS transistor.

A fourth reference voltage generation circuit of the present invention is the second reference voltage generation circuit, further including at least one of a pair of MOS transistors, which together with the first and second reference current MOS transistors form a cascode current mirror structure, and a pair of MOS transistors, which together with the first and second current mirror MOS transistors form a cascode current mirror structure.

With the above reference voltage generation circuit, the resistance value between the first node and the second node is increased, whereby it is possible to reduce the dependency of the reference voltage on the voltage at the first node.

A fifth reference voltage generation circuit of the present invention is the fourth reference voltage generation circuit wherein: at least one of the first current path and the second current path is provided with a resistive element, wherein a first, higher potential-side end of the resistive element is connected to a common gate of a higher potential-side one of the two pairs of MOS transistors together forming the cascode current mirror structure, and a second end of the resistive element is connected to a common gate of a lower potential-side one of the two pairs of MOS transistors.

A sixth reference voltage generation circuit of the present invention is the second reference voltage generation circuit, further including a MOS transistor for connecting together the drain and the source of a first one of the first and second reference current MOS transistors and the first and second current mirror MOS transistors, wherein the drain of the first transistor is connected to the gate of a second one of the pairs of transistors, the second transistor being on a lower potential-side with respect to the first transistor.

Thus, it is possible to prevent the first and second reference current MOS transistors and the first and second current mirror MOS transistors from becoming stable in a non-conductive state.

A seventh reference voltage generation circuit is the sixth reference voltage generation circuit, further including a MOS transistor for connecting together the second node and the third node.

Thus, while the MOS transistor for connecting together the drain and the source is being ON, it is possible to output, to the second node, a voltage according to the gate-source voltage of the MOS transistor for connecting together the second node and the third node.

An eighth reference voltage generation circuit of the present invention is the first reference voltage generation circuit, wherein:

the reference current generation circuit further includes a resistive element connected in series with the first reference current diode to form a resistor diode series circuit, and first and second virtual short MOS transistors;

a first end of the resistor diode series circuit is connected to the first node, and a second end thereof is connected to a source of the first virtual short MOS transistor;

a first end of the second reference current diode is connected to the first node, and a second end thereof is connected to a source of the second virtual short MOS transistor;

a gate and a drain of the second virtual short MOS transistor are connected to each other, to a gate of the first virtual short MOS transistor, and to the drain of the second current mirror MOS transistor;

the gate and the drain of the first current mirror MOS transistor are connected to each other, to a drain of the first virtual short MOS transistor, and to the gate of the second current mirror MOS transistor, and the source of the first current mirror MOS transistor is connected to the second node;

the source of the second current mirror MOS transistor is connected to the second node; and the first node is of a higher potential than the second node;

the first and second virtual short MOS transistors are each a PMOS transistor;

the first and second current mirror MOS transistors are each an NMOS transistor;

the load section MOS transistor is a PMOS transistor;

the first output stage MOS transistor is an NMOS transistor;

the second output stage MOS transistor is a PMOS transistor;

the first end of the resistor diode series circuit is an anode of the first reference current diode or an end thereof connected to the anode via the resistive element therebetween; and the first end of the second reference current diode is an anode;

or the first node is of a lower potential than the second node;

the first and second virtual short MOS transistors are each an NMOS transistor;

the first and second current mirror MOS transistors are each a PMOS transistor;

the load section MOS transistor is an NMOS transistor;

the first output stage MOS transistor is a PMOS transistor;

the second output stage MOS transistor is an NMOS transistor;

the first end of the resistor diode series circuit is a cathode of the first reference current diode or an end thereof connected to the cathode via the resistive element therebetween; and the first end of the second reference current diode is a cathode.

A ninth reference voltage generation circuit of the present invention is the eighth reference voltage generation circuit, further including at least one of a pair of MOS transistors, which together with the first and second virtual short MOS transistors form a cascode current mirror structure, and a pair of MOS transistors, which together with the first and second current mirror MOS transistors form a cascode current mirror structure.

With the above reference voltage generation circuit, the resistance value between the first node and the second node is increased, whereby it is possible to reduce the dependency of the reference voltage on the voltage at the first node.

A tenth reference voltage generation circuit of the present invention is the ninth reference voltage generation circuit, wherein: at least one of the first current path and the second current path is provided with a resistive element, wherein a first, higher potential-side end of the resistive element is connected to a common gate of a higher potential-side one of the two pairs of MOS transistors together forming the cascode current mirror structure, and a second end of the resistive element is connected to a common gate of a lower potential-side one of the two pairs of MOS transistors.

An eleventh reference voltage generation circuit of the present invention is the eighth reference voltage generation circuit, further including a MOS transistor for connecting together the drain and the source of a first one of the first and second virtual short MOS transistors and the first and second current mirror MOS transistors, wherein the drain of the first transistor is connected to the gate of a second one of the pairs of transistors, the second transistor being on a lower potential-side with respect to the first transistor.

Thus, it is possible to prevent the first and second virtual short MOS transistors and the first and second current mirror MOS transistors from becoming stable in a non-conductive state.

A twelfth reference voltage generation circuit of the present invention is the eleventh reference voltage generation circuit, further including a MOS transistor for connecting together the second node and the third node.

Thus, while the MOS transistor for connecting together the drain and the source is being ON, it is possible to output, to the second node, a voltage according to the gate-source voltage of the MOS transistor for connecting together the second node and the third node.

A thirteenth reference voltage generation circuit of the present invention is the first reference voltage generation circuit, wherein a resistance value of the resistive element of the resistive load circuit can be adjusted.

Thus, by adjusting (variably controlling) the resistance value of the resistive element, it is possible to fine-tune the output reference voltage.

A fourteenth reference voltage generation circuit of the present invention is the first reference voltage generation circuit, wherein:

the first node is connected to a first power supply; and the third node is connected to a second power supply.

A fifteenth reference voltage generation circuit of the present invention includes:

a band gap reference-type current generation circuit for controlling each of currents flowing through a first current path and a second current path, which are extending from a first node to a second node, to be a predetermined reference current, by utilizing a voltage difference occurring between a pair of transistors or diodes; and a resistive load circuit provided between the second node and a third node.

With the above reference voltage generation circuit, the current flow through the first current path and that through the second current path merge together and flow into the resistive load circuit, whereby it is possible to obtain a reference voltage with a higher precision.

A sixteenth reference voltage generation circuit of the present invention is the fifteenth reference voltage generation circuit, further including a resistive load circuit provided between the first node and a fourth node.

A seventeenth reference voltage generation circuit of the present invention is the sixteenth reference voltage generation circuit, wherein:

the fourth node is connected to a first power supply;

the third node is connected to a second power supply.

An eighteenth reference voltage generation circuit of the present invention is the fifteenth reference voltage generation circuit, wherein the band gap reference-type current generation circuit includes:

a current mirror circuit including a first current mirror MOS transistor provided along the first current path, and a second current mirror MOS transistor for conducting, through the second current path, a current being a multiple of that flowing through the first current path; and a reference current generation circuit including a first reference current MOS transistor or a first reference current diode provided along the first current path, and a second reference current MOS transistor or a second reference current diode provided along the second current path, for controlling each of currents flowing through the first and second current paths to be a constant reference current according to a gate-source voltage difference occurring in the first and second reference current MOS transistors or an anode-cathode voltage difference occurring in the first and second reference current diodes.

A nineteenth reference voltage generation circuit of the present invention is the eighteenth reference voltage generation circuit, wherein:

the reference current generation circuit further includes a resistive element a first end of which is connected to a first one of the first and second nodes;

the first reference current MOS transistor is a transistor whose source is connected to a second end of the resistive element;

the second reference current MOS transistor is a transistor whose source is connected to the first one of the first and second nodes and whose gate and drain are connected to each other and to a gate of the first reference current MOS transistor;

the first current mirror MOS transistor is a transistor whose drain and gate are connected to each other, to a drain of the first reference current MOS transistor and to a gate of the second current mirror MOS transistor, and whose source is connected to a second one of the first and second nodes;

the second current mirror MOS transistor is a transistor whose drain is connected to the drain of the second reference current MOS transistor, and whose source is connected to the second one of the first and second nodes; and the first one of the first and second nodes is of a higher potential than the second one of the first and second nodes;

the first and second reference current MOS transistors are each a PMOS transistor;

the first and second current mirror MOS transistors are each an NMOS transistor;

or the first one of the first and second nodes is of a lower potential than the second one of the first and second nodes;

the first and second reference current MOS transistors are each an NMOS transistor; and the first and second current mirror MOS transistors are each a PMOS transistor.

A twentieth reference voltage generation circuit of the present invention is the nineteenth reference voltage generation circuit, further including at least one of a pair of MOS transistors, which together with the first and second reference current MOS transistors form a cascode current mirror structure, and a pair of MOS transistors, which together with the first and second current mirror MOS transistors form a cascode current mirror structure.

With the above reference voltage generation circuit, the resistance value between the first node and the second node is increased, whereby it is possible to reduce the dependency of the reference voltage on the voltage at the first node.

A twenty-first reference voltage generation circuit of the present invention is the twentieth reference voltage generation circuit, wherein at least one of the first current path and the second current path is provided with a resistive element, wherein a first, higher potential-side end of the resistive element is connected to a common gate of a higher potential-side one of two pairs of MOS transistors together forming the cascode current mirror structure, and a second end of the resistive element is connected to a common gate of a lower potential-side one of the two pairs of MOS transistors.

A twenty-second reference voltage generation circuit of the present invention is the nineteenth reference voltage generation circuit, further including a MOS transistor for connecting together the drain and the source of a first one of the first and second reference current MOS transistors and the first and second current mirror MOS transistors, wherein the drain of the first transistor is connected to the gate of a second one of the pairs of transistors, the second transistor being on a lower potential-side with respect to the first transistor.

Thus, it is possible to prevent the first and second reference current MOS transistors and the first and second current mirror MOS transistors from becoming stable in a non-conductive state.

A twenty-third reference voltage generation circuit of the present invention is the twenty-second reference voltage generation circuit, further including a MOS transistor for connecting together the second node and the third node.

Thus, while the MOS transistor for connecting together the drain and the source is being ON, it is possible to output, to the second node, a voltage according to the gate-source voltage of the MOS transistor for connecting together the second node and the third node.

A twenty-fourth reference voltage generation circuit of the present invention is the eighteenth reference voltage generation circuit, wherein:

the reference current generation circuit further includes a resistive element connected in series with the first reference current diode to form a resistor diode series circuit, and first and second virtual short MOS transistors;

a first end of the resistor diode series circuit is connected to a first one of the first node and the second node, and a second end thereof is connected to a source of the first virtual short MOS transistor;

a first end of the second reference current diode is connected to the first one of the first node and the second node, and a second end thereof is connected to a source of the second virtual short MOS transistor;

a gate and a drain of the second virtual short MOS transistor are connected to each other, to a gate of the first virtual short MOS transistor, and to the drain of the second current mirror MOS transistor;

the gate and the drain of the first current mirror MOS transistor are connected to each other, to a drain of the first virtual short MOS transistor, and to the gate of the second current mirror MOS transistor, and the source of the first current mirror MOS transistor is connected to a second one of the first node and the second node;

the source of the second current mirror MOS transistor is connected to the second one of the first node and the second node; and the first one of the first node and the second node is of a higher potential than the second one of the first node and the second node;

the first and second virtual short MOS transistors are each a PMOS transistor;

the first and second current mirror MOS transistors are each an NMOS transistor;

the first end of the resistor diode series circuit is an anode of the first reference current diode or an end thereof connected to the anode via the resistive element therebetween; and the first end of the second reference current diode is an anode;

or the first one of the first node and the second node is of a lower potential than the second one of the first node and the second node;

the first and second virtual short MOS transistors are each an NMOS transistor;

the first and second current mirror MOS transistors are each a PMOS transistor;

the first end of the resistor diode series circuit is a cathode of the first reference current diode or an end thereof connected to the cathode via the resistive element therebetween; and the first end of the second reference current diode is a cathode.

A twenty-fifth reference voltage generation circuit of the present invention is the twenty-fourth reference voltage generation circuit, further including at least one of a pair of MOS transistors, which together with the first and second virtual short MOS transistors form a cascode current mirror structure, and a pair of MOS transistors, which together with the first and second current mirror MOS transistors form a cascode current mirror structure.

With the above reference voltage generation circuit, the resistance value between the first node and the second node is increased, whereby it is possible to reduce the dependency of the reference voltage on the voltage at the first node.

A twenty-sixth reference voltage generation circuit of the present invention is the twenty-fifth reference voltage generation circuit, wherein at least one of the first current path and the second current path is provided with a resistive element, wherein a first, higher potential-side end of the resistive element is connected to a common gate of a higher potential-side one of the two pairs of MOS transistors together forming the cascode current mirror structure, and a second end of the resistive element is connected to a common gate of a lower potential-side one of the two pairs of MOS transistors.

A twenty-seventh reference voltage generation circuit of the present invention is the twenty-fourth reference voltage generation circuit, further including a MOS transistor for connecting together the drain and the source of a first one of the first and second virtual short MOS transistors and the first and second current mirror MOS transistors, wherein the drain of the first transistor is connected to the gate of a second one of the pairs of transistors, the second transistor being on a lower potential-side with respect to the first transistor.

Thus, it is possible to prevent the first and second virtual short MOS transistors and the first and second current mirror MOS transistors from becoming stable in a non-conductive state.

A twenty-eighth reference voltage generation circuit of the present invention is the twenty-seventh reference voltage generation circuit, further including a MOS transistor for connecting together the second node and the third node.

Thus, while the MOS transistor for connecting together the drain and the source is being ON, it is possible to output, to the second node, a voltage according to the gate-source voltage of the MOS transistor for connecting together the second node and the third node.

A twenty-ninth reference voltage generation circuit of the present invention is the fifteenth reference voltage generation circuit, wherein the resistive load circuit provided between the second node and the third node includes an element in which a voltage thereacross is in proportion to a current therethrough with a positive proportionality constant, and an element in which a voltage thereacross is in proportion to an absolute temperature with a negative proportionality constant.

By using these resistive load circuits, it is possible to easily realize a reference voltage generation circuit capable of outputting a reference voltage that is not varied by variations in the absolute temperature.

A thirtieth reference voltage generation circuit of the present invention is the twenty-ninth reference voltage generation circuit, wherein the resistive load circuit, including the element in which a voltage thereacross is in proportion to a current therethrough with a positive proportionality constant and the element in which a voltage thereacross is in proportion to an absolute temperature with a negative proportionality constant, is formed by a resistive element and a diode connected in series with each other.

A thirty-first reference voltage generation circuit of the present invention is the thirtieth reference voltage generation circuit, wherein a resistance value of the resistive element of the resistive load circuit can be adjusted.

Thus, by adjusting (variably controlling) the resistance value of the resistive element, it is possible to fine-tune the output reference voltage.

A thirty-second reference voltage generation circuit of the present invention is the twenty-ninth reference voltage generation circuit, wherein the resistive load circuit, including the element in which a voltage thereacross is in proportion to a current therethrough with a positive proportionality constant and the element in which a voltage thereacross is in proportion to an absolute temperature with a negative proportionality constant, is formed by a MOS transistor and a resistive element connected in series with each other, in which a gate and a drain of the MOS transistor are connected to each other.

A thirty-third reference voltage generation circuit of the present invention is the thirty-second reference voltage generation circuit, wherein a resistance value of the resistive element of the resistive load circuit can be adjusted.

Thus, by adjusting (variably controlling) the resistance value of the resistive element, it is possible to fine-tune the output reference voltage.

A thirty-fourth reference voltage generation circuit of the present invention is the fifteenth reference voltage generation circuit, wherein:

the first node is connected to a first power supply; and the third node is connected to a second power supply.

DETAILED DESCRIPTION OF THE PREFERRED EMBODIMENT

Figure 1:
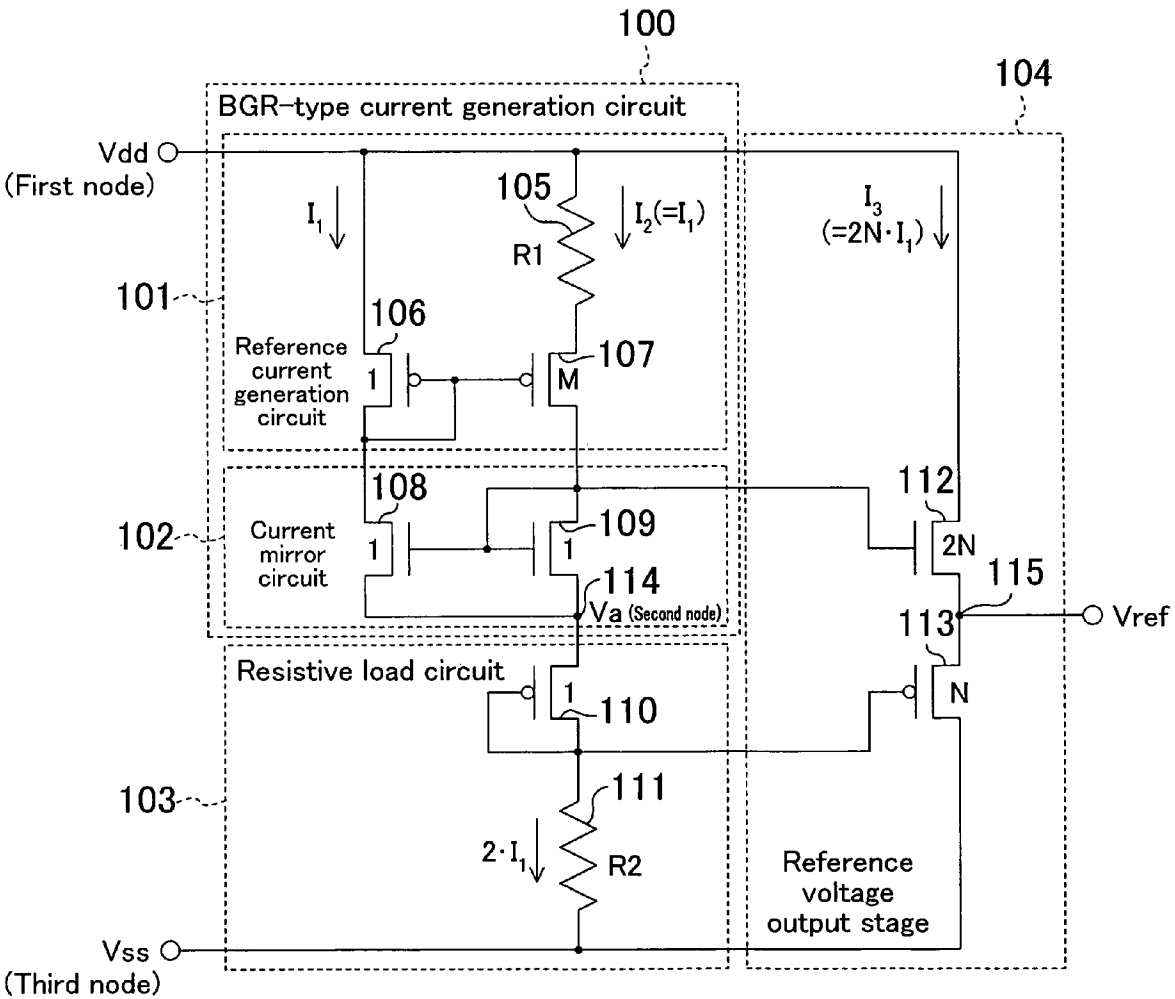
FIG. 1 is a circuit diagram showing a configuration of a reference voltage generation circuit according to Embodiment 1.

Preferred embodiments of the present invention will now be described with reference to the drawings. Note that in each of the following embodiments, elements that are functionally similar to those of any preceding embodiments will be denoted by like reference numerals, and will not be described repeatedly.

Embodiment 1

FIG. 1 is a circuit diagram showing a configuration of a reference voltage generation circuit according to Embodiment 1 of the present invention.

Referring to FIG. 1, the reference voltage generation circuit of the present embodiment includes a BGR (band gap reference)-type current generation circuit 100, a resistive load circuit 103, and a reference voltage output stage 104. The BGR-type current generation circuit 100 is connected to the first node and the second node, and the resistive load circuit 103 is connected to the second node and the third node. In the present embodiment, the first node is connected to the drain-side power supply, and the third node is connected to the source-side power supply. The potential Vdd of the drain-side power supply is higher than the potential Vss of the source-side power supply. It is assumed in embodiments herein that the potential Vss is 0V (ground voltage).

The BGR-type current generation circuit 100 includes a reference current generation circuit 101 and a current mirror circuit 102.

The reference current generation circuit 101 includes a resistive element 105, and PMOS transistors 106 and 107 (the reference current MOS transistors) whose transistor size ratio is 1:M.

The current mirror circuit 102 includes NMOS transistors 108 and 109 (the current mirror MOS transistors). The NMOS transistors 108 and 109 are designed so that an equal source-drain current flows therethrough by, for example, using the same transistor size.

The resistive load circuit 103 includes a PMOS transistor 110 (the load section MOS transistor) whose gate and drain are connected to each other (diode connection), and a resistive element 111.

The node at which the BGR-type current generation circuit 100 and the resistive load circuit 103 are connected to each other is referred to as a node 114 (the second node), and the voltage at the node 114 is denoted as Va.

The reference voltage output stage 104 includes an NMOS transistor 112 and a PMOS transistor 113 (the output stage MOS transistor), and outputs the voltage at a node 115 (the output node) as the output voltage Vref (the reference voltage).

The NMOS transistor 109 and the NMOS transistor 112, together forming a current mirror circuit, are designed so that the source-drain current ratio therebetween is 1:2N. The PMOS transistor 110 and the PMOS transistor 113, together forming a current mirror circuit, are designed so that the source-drain current ratio therebetween is 1:N.

The resistance values R1 and R2 of the resistive elements 105 and 111 and the value M in the transistor size ratio 1:M between the PMOS transistors 106 and 107 are determined so that there are little variations in the output voltage Vref with respect to variations in the temperature. How these values are determined in the present invention will now be described in detail.

It is assumed herein that the PMOS transistors 106 and 107 are operating in a sub-threshold region where the gate-source voltage is less than the threshold voltage. Where the gate-source voltage of the PMOS transistor 106 is denoted as Vgsp1, the current I1 flowing through the PMOS transistor 106 can be expressed as shown in Expression 1 below.

$$I_1 = I_{sub0}\frac{W}{L}\exp\left(\frac{qV_{gsp1}}{nkT}\right) \quad \text{Exp. 1}$$

In Expression 1, n is a constant dictated by the process, which typically is little dependent on the temperature and takes a value of about 1.4, for example. Isub0 is a constant dictated by the process, which varies with a strong positive temperature gradient with respect to variations in the temperature. W denotes the gate width of the PMOS transistor 106, L the gate length of the PMOS transistor 106, k the Boltzmann constant, T the absolute temperature, and q the charge of electron.

Where the gate-source voltage of the PMOS transistor 107 is denoted as Vgsp2, since an equal current flows through the NMOS transistors 108 and 109, the current I2 flowing through the PMOS transistor 107 is equal to I1, which is expressed as shown in Expression 2 below.

$$I_2 = I_1 = I_{sub0}\left(M\cdot\frac{W}{L}\right)\exp\left(\frac{qV_{gsp2}}{nkT}\right) \quad \text{Exp. 2}$$

Since the gate voltage of the PMOS transistor 106 is equal to that of the PMOS transistor 107, the voltage across the resistive element 105 is equal to Vgsp1−Vgsp2. Expressions 1 and 2 together yield Expression 3 below.

$$V_{gsp1} - V_{gsp2} = \frac{nkT}{q}\ln M \quad \text{Exp. 3}$$

Thus, the current I1 flowing through the resistive element 105 is expressed as shown in Expression 4 below.

$$I_1 = \frac{V_{gsp1} - V_{gsp2}}{R_1} = \frac{1}{R_1}\frac{nkT}{q}\ln M \quad \text{Exp. 4}$$

Since the current flowing from the BGR-type current generation circuit 100 into the resistive load circuit 103 (the drain current of the PMOS transistor 110) is I1+I2 (=2·I1), the voltage Va at the node 114 is a voltage obtained by adding together the voltage across the resistive element 111 and the source-gate voltage of the PMOS transistor 110. Since the NMOS transistor 112 and the PMOS transistor 113 of the reference voltage output stage 104, the NMOS transistor 109 and the PMOS transistor 110 together form a current mirror-type source follower, the same voltage as the voltage Va is output from the reference voltage output stage 104 as the output voltage Vref. Thus, the output voltage Vref is expressed as shown in Expression 5 below.

$$V_{ref}=Va=2R_2I_1+V_{gsp3} \quad \text{Exp. 5}$$

In Expression 5, Vgsp3 represents the source-gate voltage of the PMOS transistor 110.

Expressions 4 and 5 together yield Expression 6 below.

$$V_{ref}=\frac{R_2}{R_1}\frac{nkT}{q}2\ln M+V_{gsp3} \quad \text{Exp. 6}$$

The gradient of Vref with respect to variations in the absolute temperature is expressed as shown in Expression 7 below, which is obtained by partially differentiating Expression 6 with respect to the absolute temperature T.

$$\frac{\partial V_{ref}}{\partial T}=\frac{R_2}{R_1}\frac{nk}{q}2\ln M+\frac{\partial V_{gsp3}}{\partial T}=0 \quad \text{Exp. 7}$$

In Expression 7, the first term (R2·n·k·2·lnM)/(R1·q) takes a positive value, and the second term (∂Vgsp3/∂T) takes a negative value (e.g., about −1.5 mV/° C.). Thus, the voltage across the resistive element 111 has a positive coefficient with respect to the absolute temperature T, and the source-gate voltage Vgsp3 of the PMOS transistor 110 has a negative coefficient with respect to the absolute temperature T.

In the present embodiment, the resistance values R1 and R2 of the resistive elements 105 and 111 and the value M in the transistor size ratio 1:M between the PMOS transistors 106 and 107 are determined so that the temperature gradient of the output voltage Vref is zero. In other words, they are determined so that the value of Expression 7 is zero. The resistive elements 105 and 111 and the PMOS transistors 106 and 107 are designed so that R1, R2 and M are in the relationship as shown in Expression 8 below.

$$R_2=AR_1 \quad \text{Exp. 8}$$

$$A=\frac{-\frac{\partial V_{gsp3}}{\partial T}}{\frac{nk}{q}2\ln M}$$

Thus, where the transistor size ratio between the PMOS transistors 106 and 107 is 1:M, the temperature coefficient of the output voltage Vref shown in Expression 7 can be made to be zero by designing the NMOS transistors 108 and 109 so that the transistor size ratio therebetween is 1:1 and by designing the resistive elements 105 and 111 so that R1 and R2 satisfy Expression 8. Since Expression 6 has no Vdd-dependent term, the output voltage Vref is not varied by variations in the potential Vdd of the drain-side power supply, provided that ideal elements are used.

The output impedance Z is expressed as shown in Expression 9 below.

$$Z=\frac{1}{gm(N)+gm(P)} \quad \text{Exp. 9}$$

In Expression 9, gm(N) denotes the transconductance of the NMOS transistor 112, and gm(P) the transconductance of the PMOS transistor 113.

Expression 9 indicates that the greater the static current I3 flowing through the reference voltage output stage 104, the more gm(N) and gm(P) increase and the output impedance Z decreases.

Thus, the output impedance can be decreased by providing the reference voltage output stage 104, instead of directly outputting the voltage Va at the node 114.

As compared with a case where the voltage Va at the node 114 is output directly, the provision of the reference voltage output stage 104 increases the overall current flow across the circuit by the static current flowing through the reference voltage output stage 104. In FIG. 1, the source follower-type NMOS transistor 112 and the PMOS transistor 113 each form a current mirror together with the NMOS transistor 109 and the PMOS transistor 110, respectively. Therefore, the static current I3 flowing through the reference voltage output stage 104 is I3=2N·I1. For example, assume that the BGR-type current generation circuit 100 is configured so that the current I1 is 0.5 μA, and the gate width ratio between the PMOS transistor 110 and the PMOS transistor 113 is made to be 1:2, whereby N=2. Then, the current I3 flowing through the reference voltage output stage 104 is 2 μA. Thus, since the amount of current flowing through the reference voltage output stage 104 is proportional to the value N, it is possible to reduce the output impedance with little increase in the static current by employing a design such that N takes a small value.

In the reference voltage generation circuit of the present embodiment, two current paths merge together in the BGR-type current generation circuit 100 and extend as a single current path into the resistive load circuit 103. Therefore, the current consumption can be reduced more easily as compared with a case where the currents flowing through the two current paths are mirrored by the current mirror circuit and a current mirrored from the currents flows into a resistive load circuit formed along another current path. Moreover, the total circuit area is reduced because it is not necessary to provide elements for mirroring. Furthermore, the precision of the output voltage Vref is increased because there will be no situation where the current ratio between transistors used for mirroring is shifted from the desired current ratio due to variations among those transistors.

Variation of Embodiment 1

Figure 2:
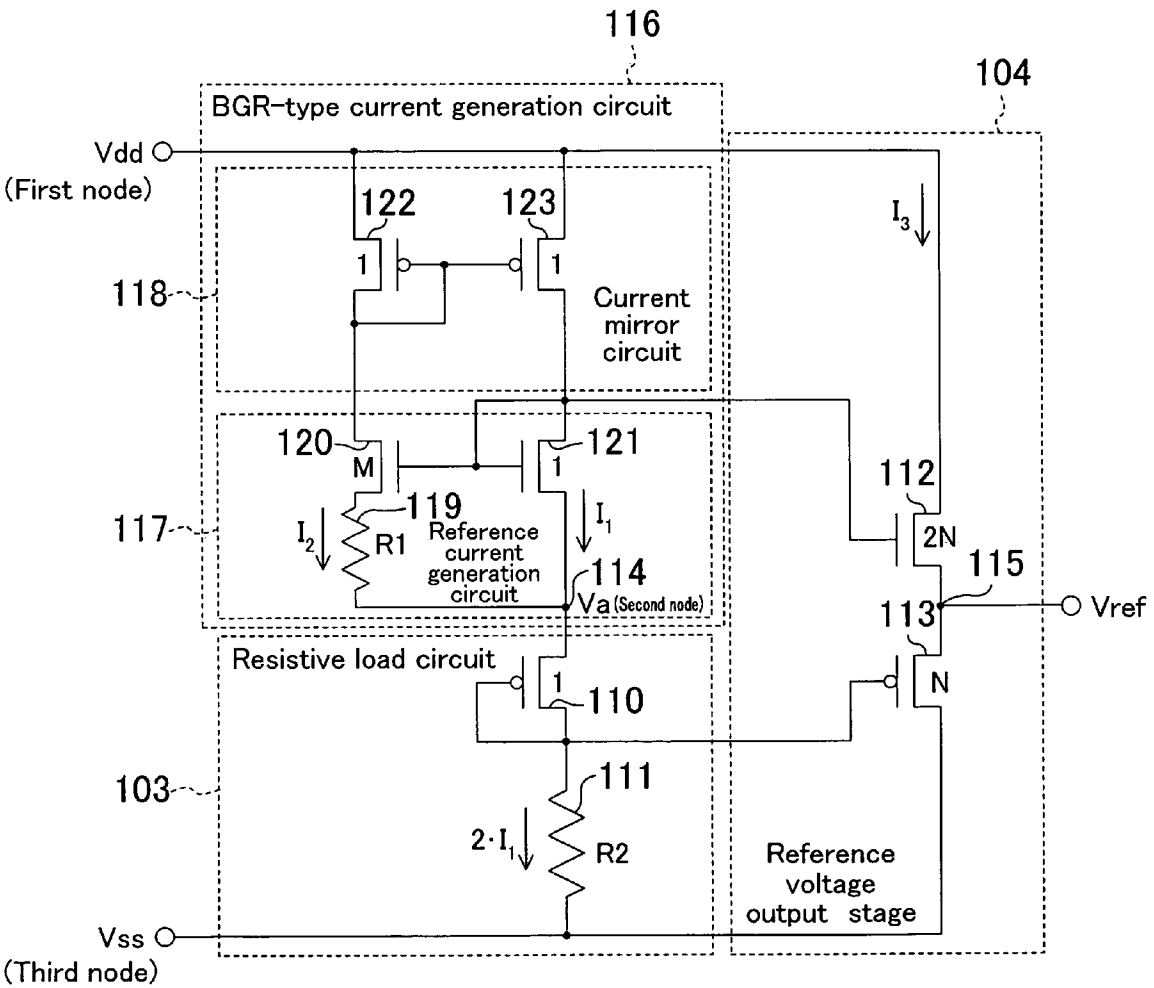
FIG. 2 is a circuit diagram showing a configuration of a reference voltage generation circuit according to a variation of Embodiment 1.

The reference voltage generation circuit of Embodiment 1 may be of a configuration as shown in FIG. 2. The reference voltage generation circuit of FIG. 2 includes a BGR-type current generation circuit 116, instead of the BGR-type current generation circuit 100 of FIG. 1.

The BGR-type current generation circuit 116 includes a reference current generation circuit 117 and a current mirror circuit 118.

The reference current generation circuit 117 includes a resistive element 119, and NMOS transistors 120 and 121 (the reference current MOS transistors) whose transistor size ratio is M:1.

The current mirror circuit 118 includes PMOS transistors 122 and 123 (the current mirror MOS transistors) designed so that an equal source-drain current flows therethrough.

The value M and the resistance values R1 and R2 of the resistive elements 119 and 111 are determined so as to satisfy Expression 8. Thus, ideally, the output voltage Vref is not varied by variations in the power supply voltage.

Also with the configuration of FIG. 2, effects similar to those described above for the configuration of FIG. 1 are realized.

Embodiment 2

Figure 3:
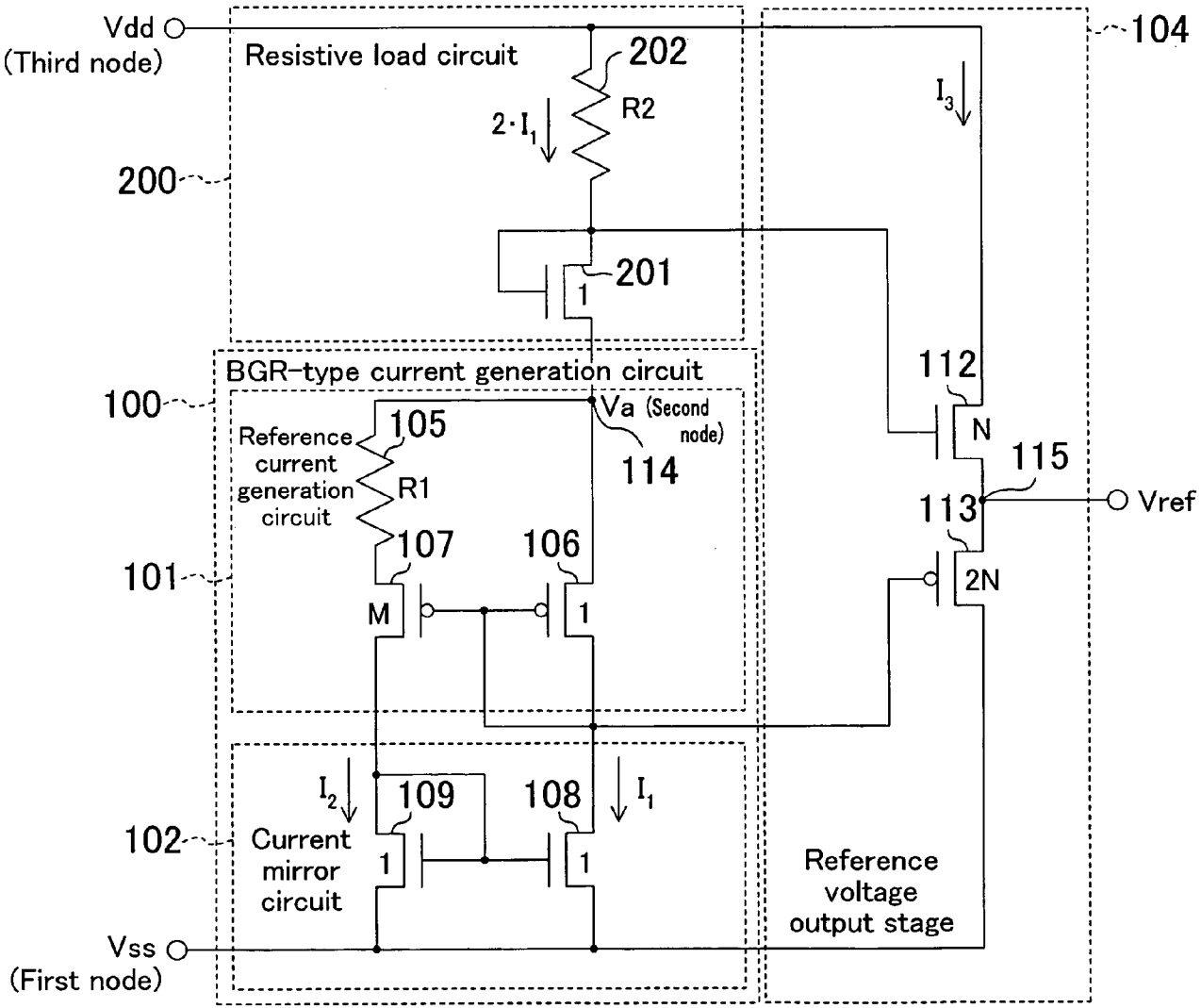
FIG. 3 is a circuit diagram showing a configuration of a reference voltage generation circuit according to Embodiment 2.

FIG. 3 is a circuit diagram showing a configuration of a reference voltage generation circuit according to Embodiment 2 of the present invention.

As shown in FIG. 3, the reference voltage generation circuit of the present embodiment includes a resistive load circuit 200, instead of the resistive load circuit 103 of reference voltage generation circuit of Embodiment 1. Moreover, the third node is connected to the drain-side power supply, and the first node is connected to the source-side power supply.

The resistive load circuit 200 includes an NMOS transistor 201 (the load section MOS transistor) and a resistive element 202.

In the present embodiment, the NMOS transistor 201 and the NMOS transistor 112, together forming a current mirror circuit, are designed so that the source-drain current ratio therebetween is 1:N. The PMOS transistor 106 and the PMOS transistor 113, together forming a current mirror circuit, are designed so that the source-drain current ratio is 1:2N.

How the resistance values R1 and R2 of the resistive elements 105 and 202 and the value M are determined will now be described. The method for deriving the voltage produced by the resistive load circuit 200, i.e., the potential difference between the drain-side power supply and the node 114, is similar to Expressions 1 to 6, and will not be further described below. The output voltage Vref is obtained as shown in Expression 10 below.

$$V_{ref} = V_{dd} - \left\{ \frac{R_2}{R_1} \frac{nkT}{q} 2\ln M + V_{gsp4} \right\} \quad \text{Exp. 10}$$

In Expression 10, n is a constant dictated by the process, which typically is little dependent on the temperature and takes a value of about 1.4, for example. In the expression, k denotes the Boltzmann constant, T the absolute temperature, q the charge of electron, and Vgsp4 the gate-source voltage of the NMOS transistor 201.

The portion in the braces in Expression 10 is of the same pattern as the right-hand side of Expression 7, and therefore the values of M, R1 and R2 are determined so that the portion in the braces partially differentiated is zero. Thus, there is obtained the temperature-independent output voltage Vref, which is based on the potential Vdd. Ideally, the output voltage Vref is constant as long as the potential Vdd is constant.

Similar effects to those of Embodiment 1 are also realized in the present embodiment.

Variation of Embodiment 2

Figure 4:
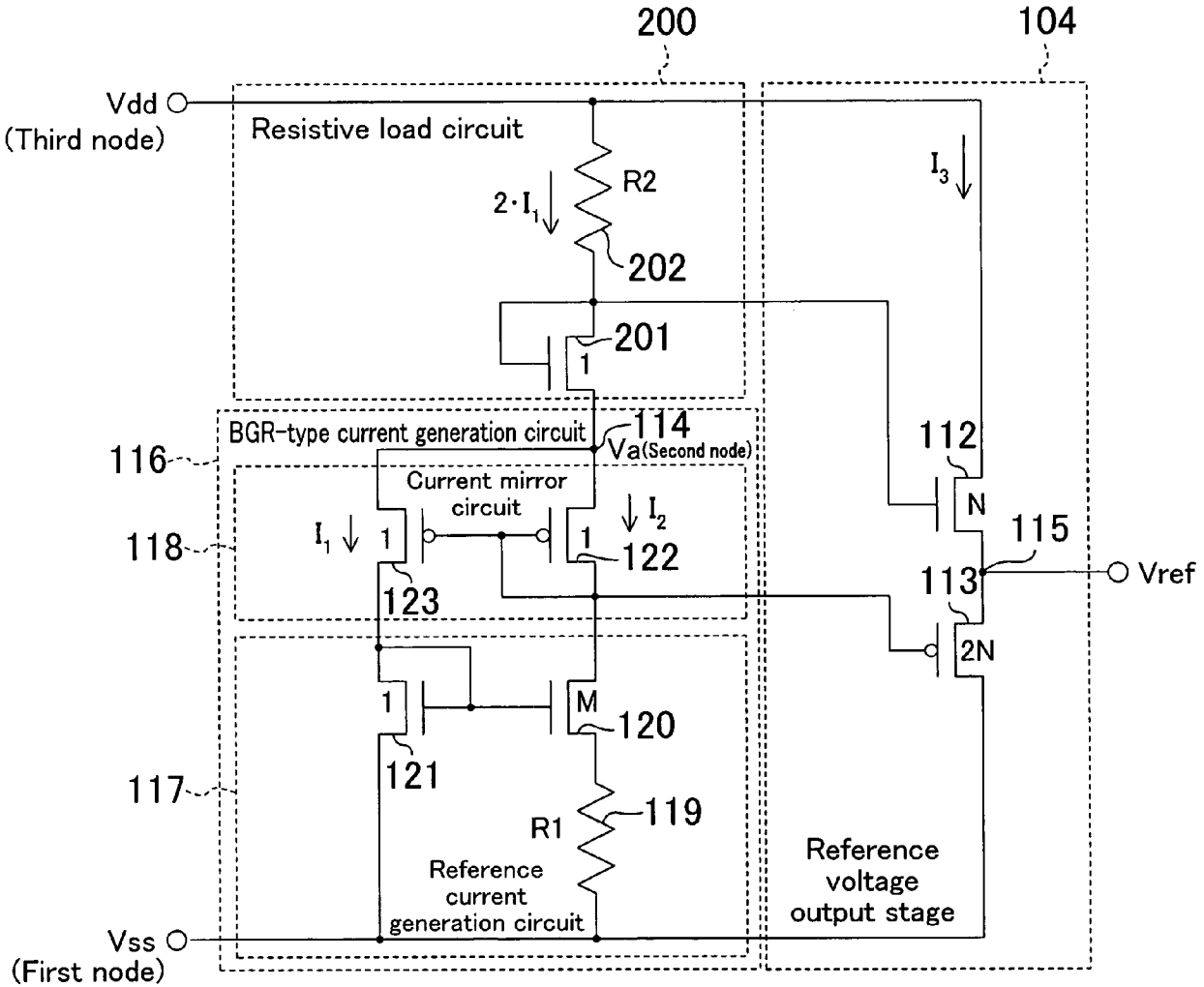
FIG. 4 is a circuit diagram showing a configuration of a reference voltage generation circuit according to a variation of Embodiment 2.

The reference voltage generation circuit of Embodiment 2 may be of a configuration as shown in FIG. 4. The reference voltage generation circuit of FIG. 4 includes the BGR-type current generation circuit 116, instead of the BGR-type current generation circuit 100 of FIG. 3.

The value M, the resistance values R1 and R2 of the resistive elements 119 and 202 are determined so that the portion in the braces in Expression 10 partially differentiated is zero.

Also with the configuration of FIG. 4 effects similar to those described above for the configuration of FIG. 3 are realized.

Embodiment 3

Figure 5:
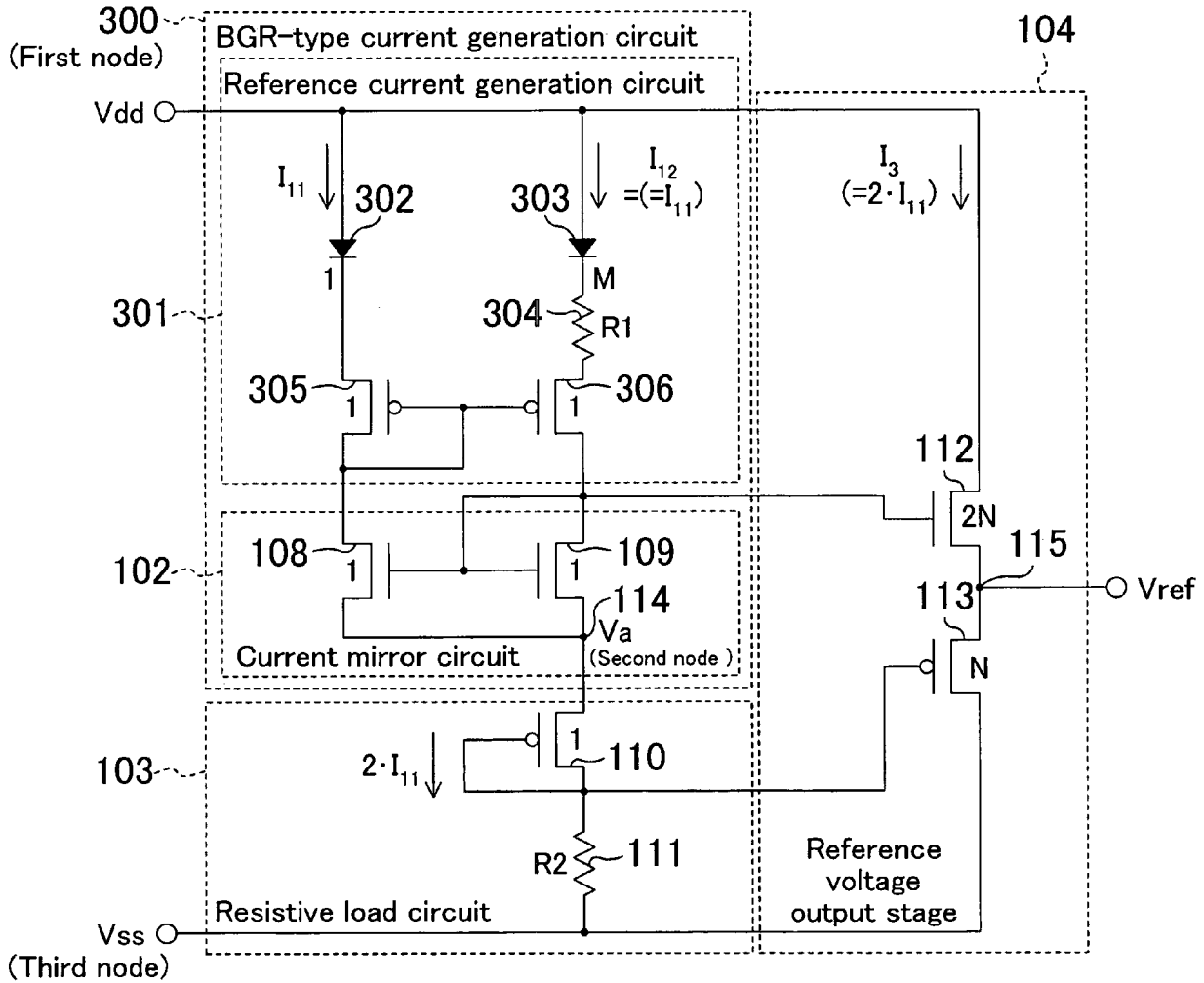
FIG. 5 is a circuit diagram showing a configuration of a reference voltage generation circuit according to Embodiment 3.

FIG. 5 is a circuit diagram showing a configuration of a reference voltage generation circuit according to Embodiment 3 of the present invention.

As shown in FIG. 5, the reference voltage generation circuit of the present embodiment includes a BGR-type current generation circuit 300, instead of the BGR-type current generation circuit 100 of the reference voltage generation circuit of Embodiment 1 shown in FIG. 1. The BGR-type current generation circuit 300 includes a reference current generation circuit 301, instead of the reference current generation circuit 101 of the BGR-type current generation circuit 100.

The reference current generation circuit 301 includes diodes 302 and 303 (the reference current diodes), a resistive element 304, and PMOS transistors 305 and 306 (the virtual short MOS transistors).

The diodes 302 and 303 are designed so that the diode size ratio therebetween is 1:M, whereby the reverse saturation current ratio therebetween is 1:M.

The PMOS transistors 305 and 306 are designed so that an equal source-drain current flows therethrough by, for example, using the same transistor size.

The resistance values R1 and R2 of the resistive elements 304 and 111 and the value M are determined so that there are little variations in the output voltage Vref with respect to variations in the temperature. How these values are determined in the present invention will now be described in detail.

Referring to FIG. 5, where the anode-cathode voltage of the diode 302 is denoted as Vd1, the current I1 flowing through the diode 302 can be expressed as shown in Expression 11 below.

$$I_{11} = I_s \exp\left(\frac{qV_{d1}}{kT}\right) \quad \text{Exp. 11}$$

In Expression 11, Is denotes the reverse saturation current of the diode 302, k the Boltzmann constant, T the absolute temperature, and q the charge of electron.

Moreover, where the anode-cathode voltage of the diode 303 is denoted as Vd2, the current I12 flowing through the diode 303 is equal to the current I11, and therefore I11 can be expressed as shown in Expression 12 below.

$$I_{12} = I_{11} = MI_s \exp\left(\frac{qV_{d2}}{kT}\right) \quad \text{Exp. 12}$$

Moreover, currents I11 and I12, which are equal to each other, flow through the PMOS transistors 305 and 306, respectively, whereby the source potentials of the PMOS transistors 305 and 306 are equal to each other.

Thus, the voltage across the resistive element 304 is Vd1−Vd2, which is expressed as shown in Expression 13 below, based on Expressions 11 and 12.

$$V_{d1} - V_{d2} = \frac{kT}{q}\ln M \quad \text{Exp. 13}$$

Based on Expression 13, the current I11 flowing through the resistive element 304 is expressed as shown in Expression 14 below.

$$I_{11} = \frac{V_{d1} - V_{d2}}{R_1} = \frac{1}{R_1}\frac{kT}{q}\ln M \quad \text{Exp. 14}$$

Since the current flowing from the BGR-type current generation circuit 300 into the resistive load circuit 103, i.e., the current flowing through the resistive load circuit 103, is I11+I12(=2·I11), the voltage Va at the node 114 is a voltage obtained by adding together the voltage across the resistive element 111 and the source-gate voltage of the PMOS transistor 110. The NMOS transistor 112 and the PMOS transistor 113 of the reference voltage output stage 104 each form a current mirror-type source follower together with the NMOS transistor 109 and the PMOS transistor 110, respectively. Therefore, the reference voltage Vref is equal to the voltage Va. Thus, the output voltage Vref is expressed as shown in Expression 15 below.

$$V_{ref}=V_a=2R_2I_{11}+V_{gsp4} \quad \text{Exp. 15}$$

In Expression 15, Vgsp4 denotes the source-gate voltage of the PMOS transistor 110.

Expressions 14 and 15 together yield Expression 16 below.

$$V_{ref} = \frac{R_2}{R_1}\frac{kT}{q}2\ln M + V_{gsp4} \quad \text{Exp. 16}$$

The gradient of Vref with respect to variations in the absolute temperature is expressed as shown in Expression 17, which is obtained by partially differentiating Expression 16 with respect to the absolute temperature T.

$$\frac{\partial V_{ref}}{\partial T} = \frac{R_2}{R_1}\frac{k}{q}2\ln M + \frac{\partial V_{gsp4}}{\partial T} = 0 \quad \text{Exp. 17}$$

The first term (R2·k·2·lnM)/(R1·q) of Expression 17 takes a positive value, and the second term (∂Vgsp4/∂T) takes a negative value (e.g., about −1.5 mV/° C.). Thus, the voltage across the resistive element 111 has a positive coefficient with respect to the absolute temperature T, and the source-gate voltage Vgsp4 of the PMOS transistor 110 has a negative coefficient with respect to the absolute temperature T.

In the present embodiment, the constants R1, R2 and M are determined so that the temperature gradient of the output voltage Vref is zero. In other words, they are determined so that the value of Expression 17 is zero. Therefore, the resistive elements 304 and 111 and the diodes 302 and 303 are designed so that R1, R2 and M are in the relationship as shown in Expression 18 below.

$$R_2 = CR_1 \quad \text{Exp. 18}$$

$$C = \frac{-\frac{\partial V_{gsp4}}{\partial T}}{\frac{k}{q}2\ln M}$$

Thus, where the diode size ratio between the diodes 302 and 303 is 1:M, the source-drain currents of the NMOS transistors 108 and 109 are equal to each other (i.e., the current ratio therebetween is 1:1) and the source-drain currents of the PMOS transistors 305 and 306 are equal to each other (i.e., the current ratio therebetween is 1:1), the temperature coefficient of the output voltage Vref shown in Expression 17 can be made to be zero by designing the resistive elements 304 and 111 so that R1 and R2 satisfy Expression 18. Since Expression 17 has no Vdd-dependent term, the output voltage Vref is not varied by variations in the potential Vdd of the drain-side power supply, provided that ideal elements are used.

Similar effects to those of Embodiment 1 are also realized in the present embodiment.

Variation of Embodiment 3

Figure 6:
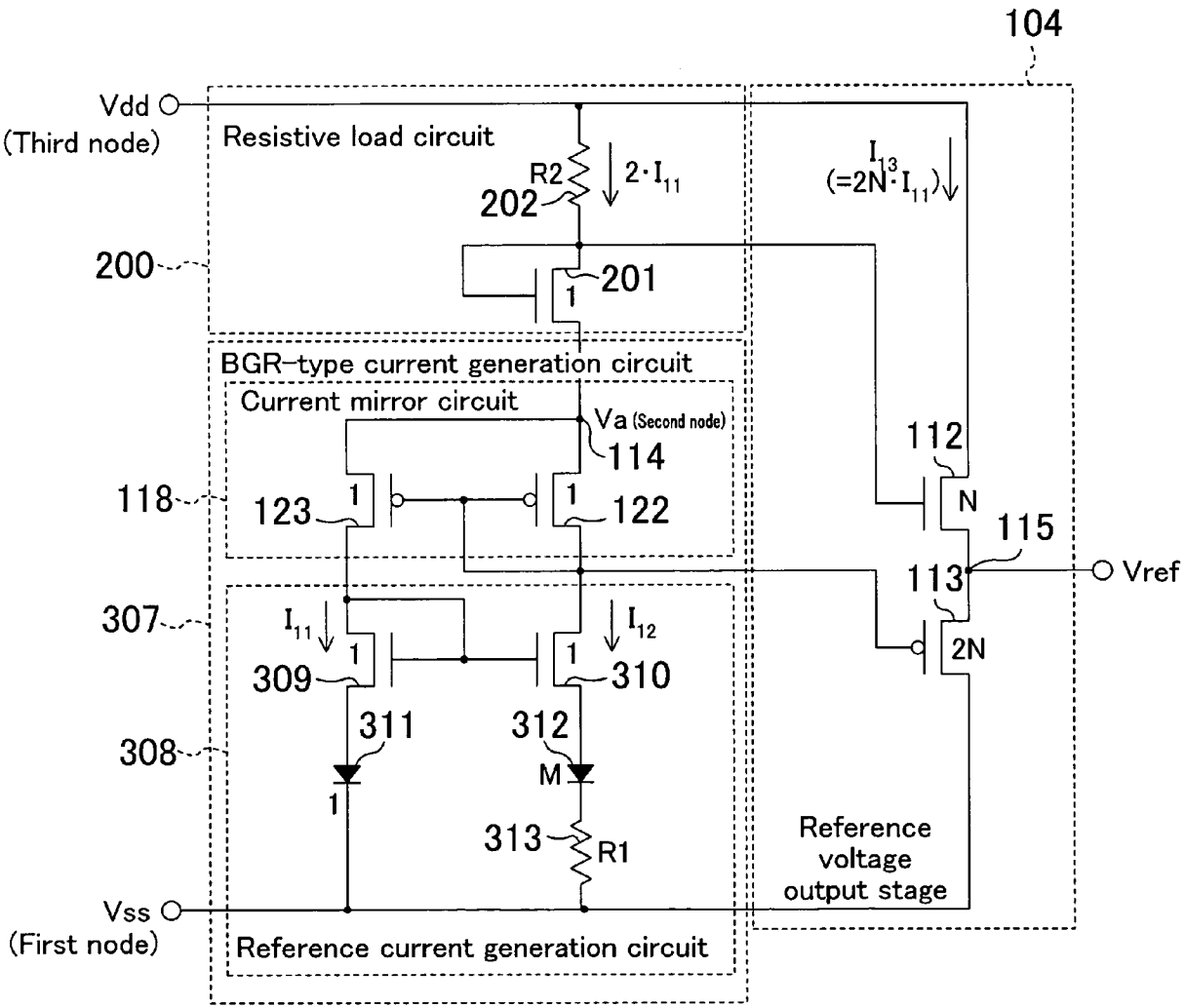
FIG. 6 is a circuit diagram showing a configuration of a reference voltage generation circuit according to a variation of Embodiment 3.

The reference voltage generation circuit of Embodiment 3 may be of a configuration as shown in FIG. 6. The reference voltage generation circuit of FIG. 6 includes a BGR-type current generation circuit 307, instead of the BGR-type current generation circuit 300 of FIG. 5. The BGR-type current generation circuit 307 includes the current mirror circuit 118 and a reference current generation circuit 308. Moreover, the third node is connected to the drain-side power supply, and the first node is connected to the source-side power supply.

The reference current generation circuit 308 includes NMOS transistors 309 and 310 (the virtual short MOS transistors), diodes 311 and 312 (the reference current diodes), and a resistive element 313.

The NMOS transistors 309 and 310 are designed so that an equal source-drain current flows therethrough by, for example, using the same transistor size.

The diodes 311 and 312 are designed so that the diode size ratio therebetween is 1:M, whereby the reverse saturation current ratio therebetween is 1:M.

How the resistance values R1 and R2 of the resistive elements 313 and 202 and the value M are determined will now be described. The method for deriving the voltage produced by the resistive load circuit 200, i.e., the potential difference between the drain-side power supply and the node 114, is similar to Expressions 11 to 16, and will not be further described below. The output voltage Vref is obtained as shown in Expression 19 below.

$$V_{ref} = V_{dd} - \left\{\frac{R_2}{R_1}\frac{kT}{q}2\ln M + V_{gsp4}\right\} \quad \text{Exp. 19}$$

In Expression 19, k denotes the Boltzmann constant, T the absolute temperature, q the charge of electron, and Vgsp4 the gate-source voltage of the NMOS transistor 201.

The portion in the braces in Expression 19 is of the same pattern as the right-hand side of Expression 16, and therefore the values of R1 and R2 are determined so that the portion in the braces partially differentiated is zero. Thus, there is obtained the temperature-independent output voltage Vref, which is based on Vdd. Ideally, the output voltage Vref is constant as long as Vdd is constant.

Similar effects to those of Embodiment 1 are also realized in the present embodiment.

Moreover, it is easier with diodes, than with MOS transistors, to realize little process variations. Therefore, as compared with a case where a BGR-type current generation circuit employed generates a current by utilizing the difference between the gate-source voltages of two MOS transistors as in Embodiments 1 and 2, it is easier to realize a more precise current in a case where a BGR-type current generation circuit employed generates a current by utilizing the difference between the anode-cathode voltages of two diodes as in the present embodiment.

Embodiment 4

Figure 7:
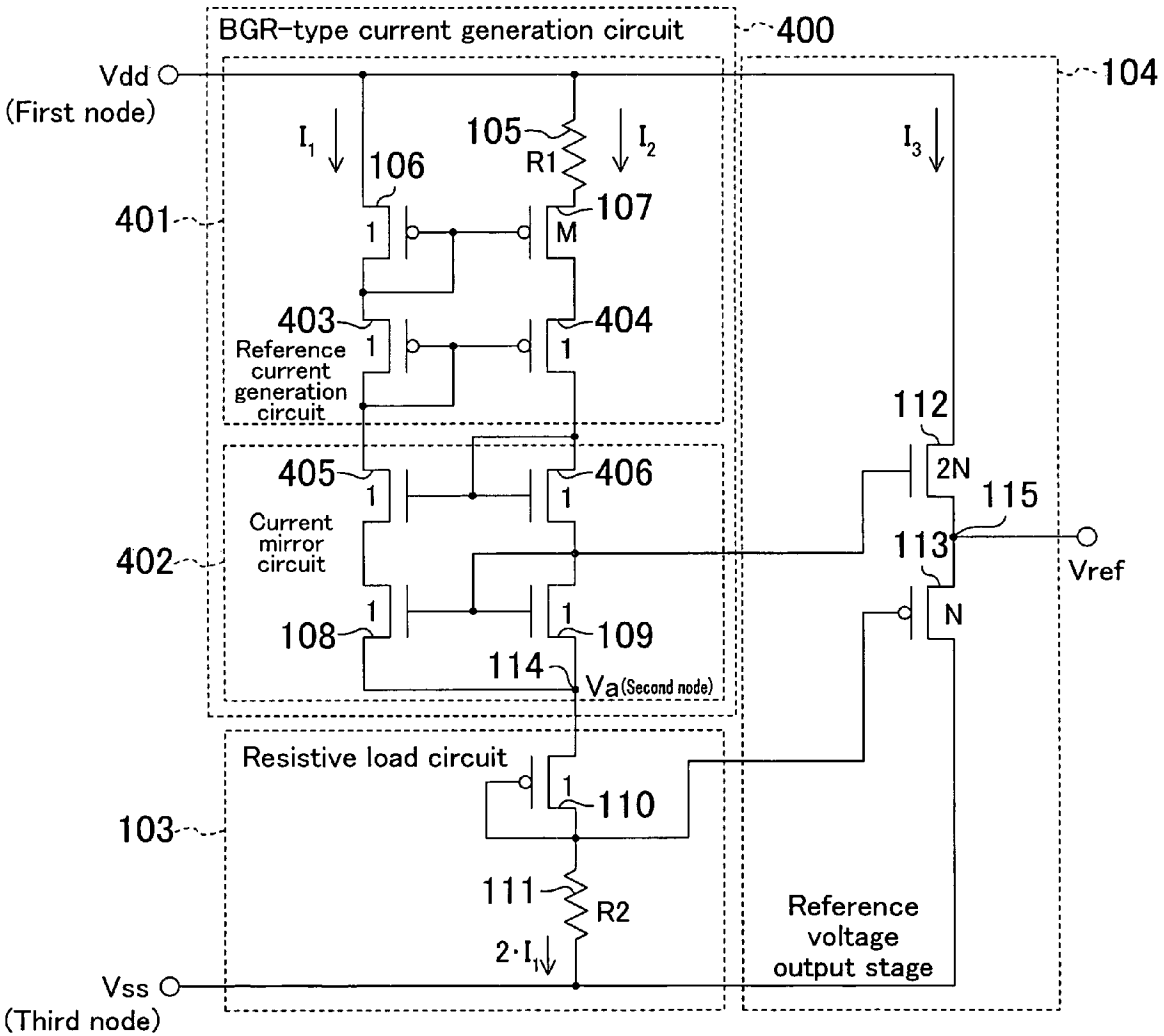
FIG. 7 is a circuit diagram showing a configuration of a reference voltage generation circuit according to Embodiment 4.

FIG. 7 is a circuit diagram showing a configuration of a reference voltage generation circuit according to Embodiment 4 of the present invention.

As shown in FIG. 7, the reference voltage generation circuit of the present embodiment includes a BGR-type current generation circuit 400, instead of the BGR-type current generation circuit 100 of the reference voltage generation circuit shown in FIG. 1. The BGR-type current generation circuit 400 includes a reference current generation circuit 401 and a current mirror circuit 402.

The reference current generation circuit 401 includes a pair of PMOS transistors 403 and 404 connected together in a cascode connection to the PMOS transistors 106 and 107, in addition to the configuration of the reference current generation circuit 101 of the reference voltage generation circuit shown in FIG. 1. The PMOS transistors 106, 107, 403 and 404 together form a cascode current mirror structure. The current mirror circuit 402 includes a pair of NMOS transistors 405 and 406 connected together in a cascode connection to the NMOS transistors 108 and 109, in addition to the configuration of the current mirror circuit 402 of the reference voltage generation circuit shown in FIG. 1. The NMOS transistors 108, 109, 405 and 406 together form a cascode current mirror structure. As with the PMOS transistors 106 and 107, the PMOS transistors 403 and 404 are designed so that an equal source-drain current flows therethrough by, for example, using the same transistor size.

As with the NMOS transistors 108 and 109, the NMOS transistors 405 and 406 are designed so that an equal source-drain current flows therethrough by, for example, using the same transistor size.

By arranging the MOS transistors of a BGR-type current generation circuit in a cascode current mirror configuration as described above, the resistance value between the first node and the second node becomes large, whereby there are little variations in the current I1 due to variations in the potential at the first node (the power supply potential). Thus, the constancy of the current I1 is much better than that with the BGR-type current generation circuit 100 of Embodiment 1.

The characteristics of the present embodiment can be incorporated into the reference voltage generation circuits of Embodiments 1 to 3 shown in FIGS. 2 to 6. Specifically, any of the reference voltage generation circuits of FIGS. 2 to 6 may include two pairs of MOS transistors together forming a cascode current mirror structure, instead of a pair of MOS transistors included in the reference current generation circuit, as in the present embodiment. Alternatively, two pairs of MOS transistors together forming a cascode current mirror structure may be provided, instead of a pair of MOS transistors included in the current mirror circuit.

Variation of Embodiment 4

Figure 8:
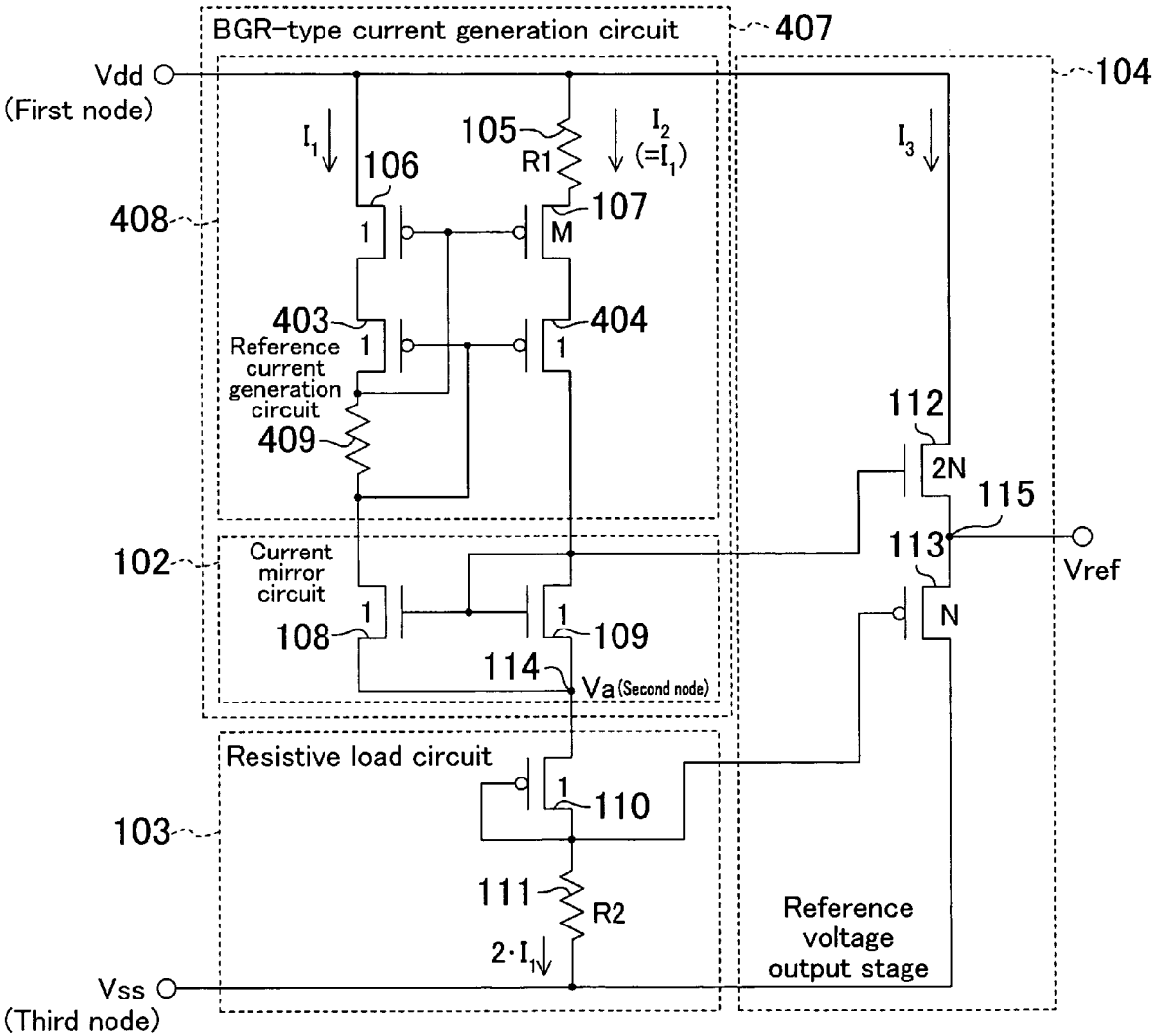
FIG. 8 is a circuit diagram showing a configuration of a reference voltage generation circuit according to a variation of Embodiment 4.

The reference voltage generation circuit of Embodiment 4 may be of a configuration as shown in FIG. 8. In addition to the configuration of the reference current generation circuit 401 of the reference voltage generation circuit shown in FIG. 7, a reference current generation circuit 408 of the reference voltage generation circuit shown in FIG. 8 includes a resistive element 409, thus forming a self-biased cascode connection circuit. With such a configuration, the constancy of the current I1 flowing through a BGR-type current generation circuit 407 is better than that with the BGR-type current generation circuits of FIGS. 1 to 4, etc., as with the case shown in FIG. 7. Moreover, the configuration of FIG. 8 realizes an operation at a lower voltage than that of FIG. 7.

Also in a case where two pairs of MOS transistors together forming a current mirror structure as described above in Embodiment 4 are provided in the reference voltage generation circuits of Embodiments 1 to 3 shown in FIGS. 2 to 6, effects similar to those of FIG. 8 are realized by providing a resistive element, wherein a first, higher potential-side end of the resistive element is connected to the common gate of a higher potential-side one of two pairs of MOS transistors connected together in a cascode connection, with the other end of the resistive element being connected to the common gate of the other, lower potential-side one of the two pairs of MOS transistors.

Embodiment 5

Figure 9:
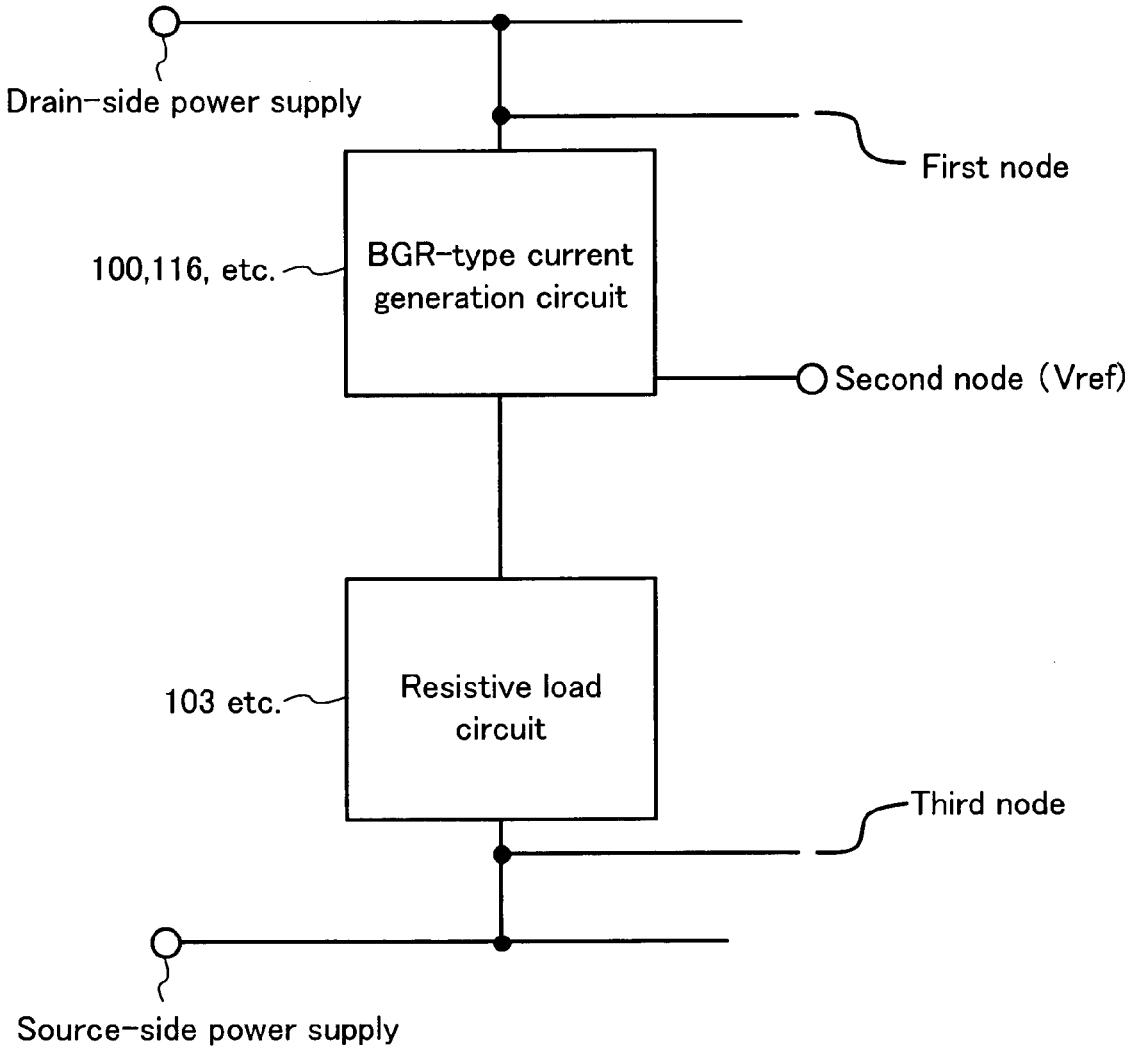
FIG. 9 is a block diagram showing an example of a basic circuit configuration of a reference voltage generation circuit configured so that the voltage Va at a node 114 is output as it is as the output voltage Vref.
Figure 10:
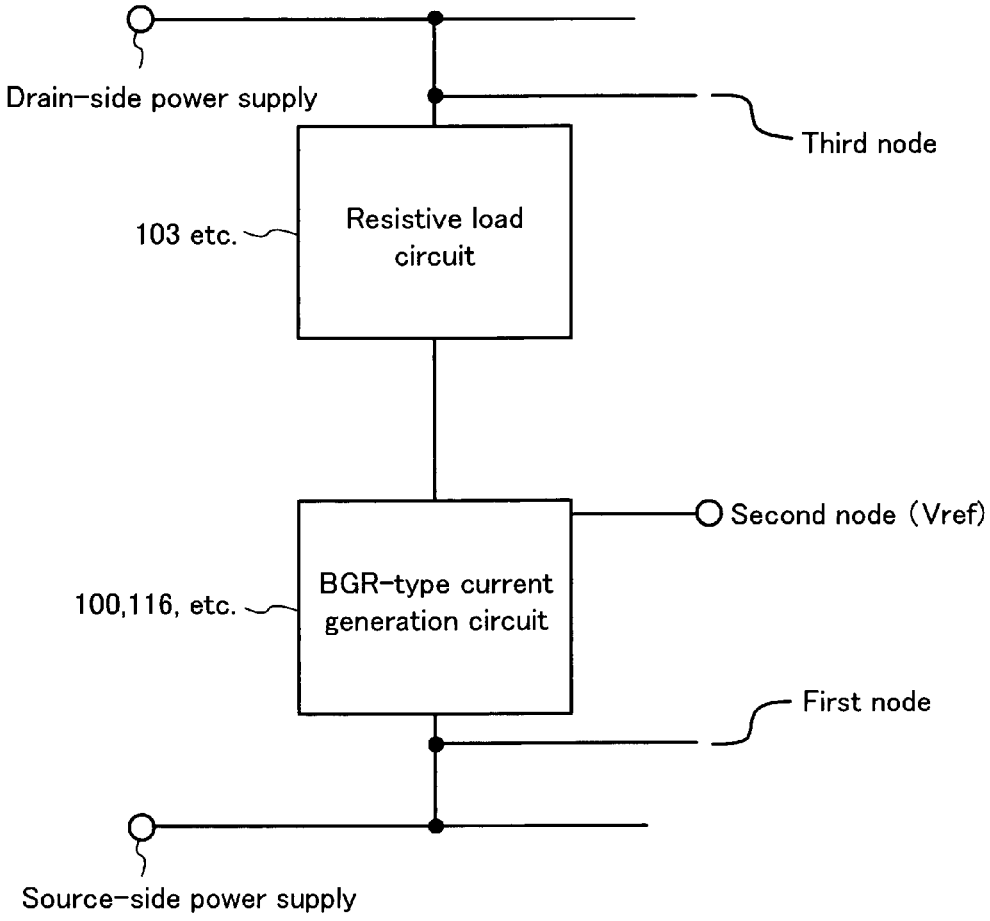
FIG. 10 is a block diagram showing an example of a basic circuit configuration of a reference voltage generation circuit configured so that the voltage Va at a node 114 is output as it is as the output voltage Vref.

With the reference voltage generation circuits of Embodiments 1 to 4 shown in FIGS. 1 to 8, the voltage Va at the node 114 may be output as it is as the output voltage Vref, without providing the reference voltage output stage 104. In such a case, the basic circuit configuration of the reference voltage generation circuit is as shown in FIG. 9 or 10. In both of the reference voltage generation circuits shown in FIGS. 9 and 10, the BGR-type current generation circuit and the resistive load circuit are connected in series with each other between the drain-side power supply and the source-side power supply. With the configuration of FIG. 9, the current generated in the BGR-type current generation circuit flows into the resistive load circuit, and the voltage Vref based on the potential Vss of the source-side power supply occurs at the second node. In the configuration of FIG. 10, in comparison with that of FIG. 9, the position of the BGR-type current generation circuit and that of the resistive load circuit are reversed. With such a configuration, there occurs the voltage Vref based on the potential Vdd of the drain-side power supply due to a voltage drop in the resistive load circuit.

Figure 11:
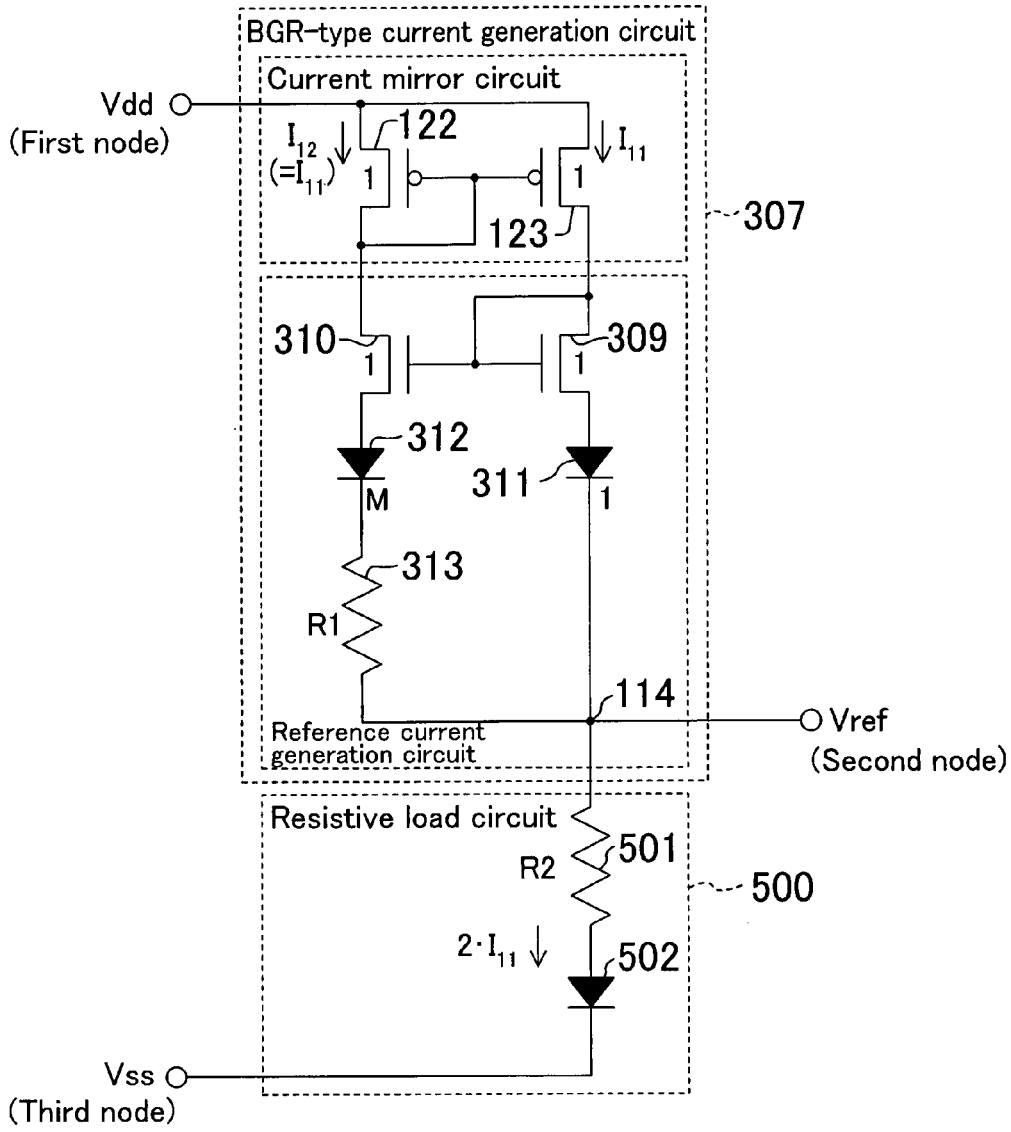
FIG. 11 is a circuit diagram showing a configuration of a reference voltage generation circuit according to Embodiment 5.

Specific circuit configurations applicable include a configuration as shown in FIG. 11, in addition to those obtained by removing the reference voltage output stage 104 from the reference voltage generation circuits of FIGS. 1 to 8.

The reference voltage generation circuit shown in FIG. 11 will now be described as the reference voltage generation circuit of Embodiment 5. Referring to FIG. 11, the reference voltage generation circuit of the present embodiment includes the BGR-type current generation circuit 307 and a resistive load circuit 500.

The resistive load circuit 500 includes a resistive element 501 and a diode 502.

How the resistance values R1 and R2 of the resistive elements 313 and 501 and the value M are determined will now be described. The method for deriving the currents I1 and I2 flowing through the BGR-type current generation circuit 307 is similar to Expressions 11 to 14, and will not be further described below. Where the anode-cathode voltage of the diode 502 is denoted as Vd3, the output voltage Vref is obtained as shown in Expression 20 below.

$$V_{ref}=2R_2I_{11}+V_{d3} \quad \text{Exp. 20}$$

Expressions 14 and 20 together yield Expression 21.

$$V_{ref} = \frac{R_2}{R_1}\frac{kT}{q}2\ln M + V_{d3} \quad \text{Exp. 21}$$

The gradient of Vref with respect to variations in the absolute temperature is expressed as shown in Expression 22, which is obtained by partially differentiating Expression 21 with respect to the absolute temperature T.

$$\frac{\partial V_{ref}}{\partial T} = \frac{R_2}{R_1}\frac{k}{q}2\ln M + \frac{\partial V_{d3}}{\partial T} = 0 \quad \text{Exp. 22}$$

The first term (R2·k·2·lnM)/(R1·q) of Expression 22 takes a positive value, and the second term (∂Vd3/∂T) takes a negative value (e.g., about −2 mV/° C.). Thus, the voltage across the resistive element 501 has a positive coefficient with respect to the absolute temperature T, and the anode-cathode voltage Vd3 of the diode 502 has a negative coefficient with respect to the absolute temperature T.

The constants R1, R2 and M are determined so that the temperature gradient of the output voltage Vref is zero. In other words, they are determined so that the value of Expression 22 is zero. Therefore, the resistive elements 313 and 501 and the diodes 311 and 312 are designed so that R1, R2 and M are in the relationship as shown in Expression 23 below.

$$R_2 = DR_1 \quad D = \frac{-\frac{\partial V_{d3}}{\partial T}}{\frac{k}{q}2\ln M} \quad \text{Exp. 23}$$

Thus, where the diode size ratio between the diodes 311 and 312 is 1:M, the source-drain currents of the PMOS transistors 122 and 123 are equal to each other (i.e., the current ratio therebetween is 1:1) and the source-drain currents of the NMOS transistors 309 and 310 are equal to each other (i.e., the current ratio therebetween is 1:1), the temperature coefficient of the output voltage Vref shown in Expression 22 can be made to be zero by designing the resistive elements so that R1 and R2 satisfy Expression 23. Since Expression 21 has no Vdd-dependent term, the output voltage Vref ideally is not varied by variations in the potential Vdd of the drain-side power supply.

In the reference voltage generation circuit of the present embodiment, two current paths extending from the drain-side power supply of the BGR-type current generation circuit 307 to the node 114 merge together and extend as a single current path into the resistive load circuit. Therefore, the current consumption can be reduced more easily as compared with a case where the currents flowing through the two current paths are mirrored by the current mirror circuit and a current mirrored from the currents flows into a resistive load circuit formed along another current path. For example, if a current of 0.5 μA is conducted through a first current path in the reference voltage generation circuit of FIG. 5 of Patent Document 1 described above in the Description of the Background Art section, a total of 0.5×3=1.5 μA is consumed by the entire reference voltage generation circuit because there are three current paths. In contrast, if I1=0.5 μA in the reference voltage generation circuit of the present embodiment, the current consumption for the entire reference voltage generation circuit is 2·I1=1 μA.

Moreover, the total circuit area is reduced because it is not necessary to provide elements for mirroring, as compared with a case where the currents flowing through the two current paths are mirrored by the current mirror circuit and a current mirrored from the currents flows into a resistive load circuit formed along another current path, as with the conventional configuration. Furthermore, the precision of the output voltage Vref is increased because there will be no situation where the current ratio between transistors used for mirroring is shifted from the desired current ratio due to variations among those transistors.

Moreover, diodes typically have less process variations than MOS transistors. Therefore, in a case where the diode 502 is used in the resistive load circuit 500 as in the present embodiment, as compared with a case where a MOS transistor is used, there are smaller variations in the output voltage Vref, and it is easier to realize a more precise reference voltage generation circuit.

Typically, the threshold voltage of a PMOS transistor can be made lower than the forward voltage of a diode. Therefore, in a case where a PMOS transistor is used in the resistive load circuit as in a configuration obtained by removing the reference voltage output stage 104 from the reference voltage generation circuit of FIG. 1, it is possible to operate the circuit with a lower drain-side power supply potential Vdd by appropriately determining the size of the PMOS transistor, as compared with a case where a diode is used as in the present embodiment.

Variation of Embodiment 5

A reference voltage generation circuit shown in FIG. 12 will now be described as a variation of the reference voltage generation circuit of Embodiment 5.

Figure 12:
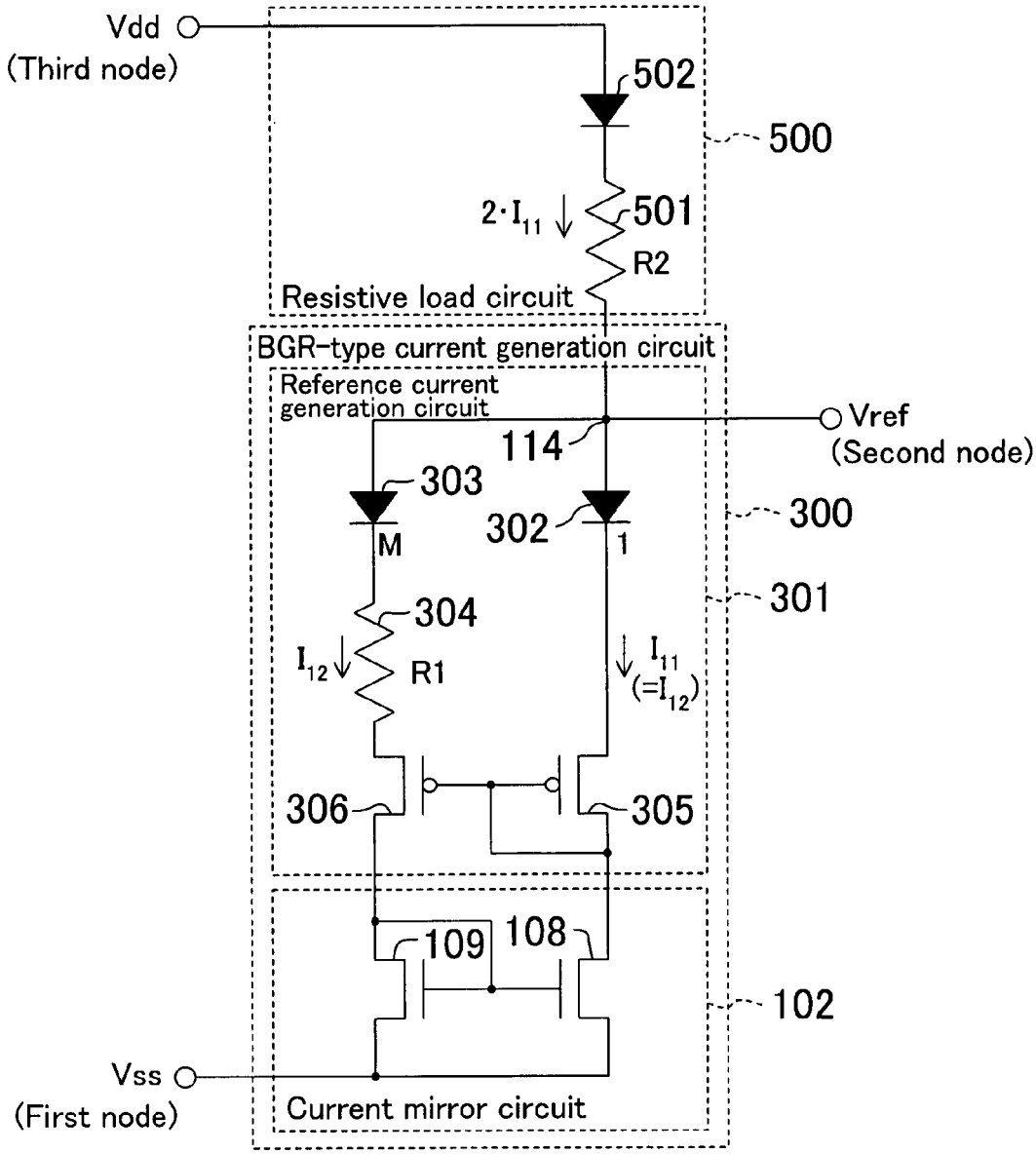
FIG. 12 is a circuit diagram showing a configuration of a reference voltage generation circuit according to a variation of Embodiment 5.

The reference voltage generation circuit of FIG. 12 includes the resistive load circuit 500 and the BGR-type current generation circuit 300.

How the resistance values R1 and R2 of the resistive elements 304 and 501 and the value M are determined will now be described. The method for deriving the voltage produced by the resistive load circuit 500, i.e., the potential difference between the drain-side power supply and the node 114, is similar to Expressions 21 to 22, and will not be further described below. The output voltage Vref is obtained as shown in Expression 24 below.

$$V_{ref} = V_{dd} - \left\{\frac{R_2}{R_1}\frac{kT}{q}2\ln M + V_{d3}\right\} \quad \text{Exp. 24}$$

In Expression 24, k denotes the Boltzmann constant, T the absolute temperature, q the charge of electron, and Vd3 the anode-cathode voltage of the diode 502.

The portion in the braces in Expression 24 is of the same pattern as the right-hand side of Expression 21, and therefore the values of R1 and R2 are determined so that the portion in the braces partially differentiated is zero. Thus, there is obtained the temperature-independent output voltage Vref, which is based on Vdd. Ideally, the output voltage Vref is constant as long as Vdd is constant.

Similar effects to those of Embodiment 5 are also realized in the present embodiment.

Embodiment 6

Figure 13:
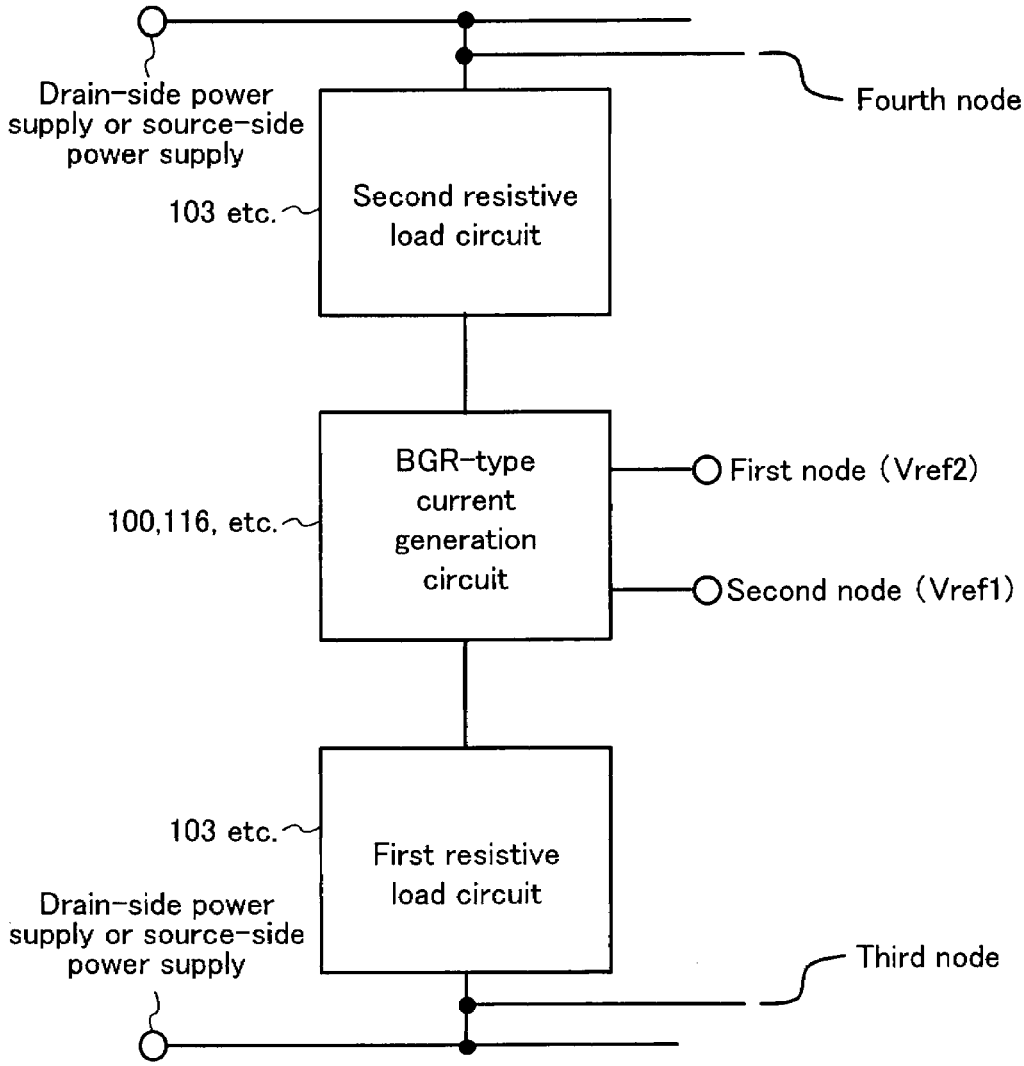
FIG. 13 is a block diagram showing a basic circuit configuration of a reference voltage generation circuit according to Embodiment 6.

FIG. 13 is a block diagram showing a basic circuit configuration of a reference voltage generation circuit according to Embodiment 6 of the present invention.

Referring to FIG. 13, the reference voltage generation circuit of the present embodiment differs from the reference voltage generation circuit of FIG. 9 in that a second resistive load circuit is provided between the drain-side power supply and the BGR-type current generation circuit. With the reference voltage generation circuit of the present embodiment, the following two voltages can be obtained, i.e., the output voltage Vref1 and the output voltage Vref2. The voltage value of the output voltage Vref1 is based on the amount of voltage drop in the first resistive load circuit with reference to the voltage of one of the source-side power supply and the drain-side power supply, and the voltage value of the output voltage Vref2 is based on the amount of voltage drop in the second resistive load circuit with reference to the other one of the source-side power supply and the drain-side power supply.

Figure 14:
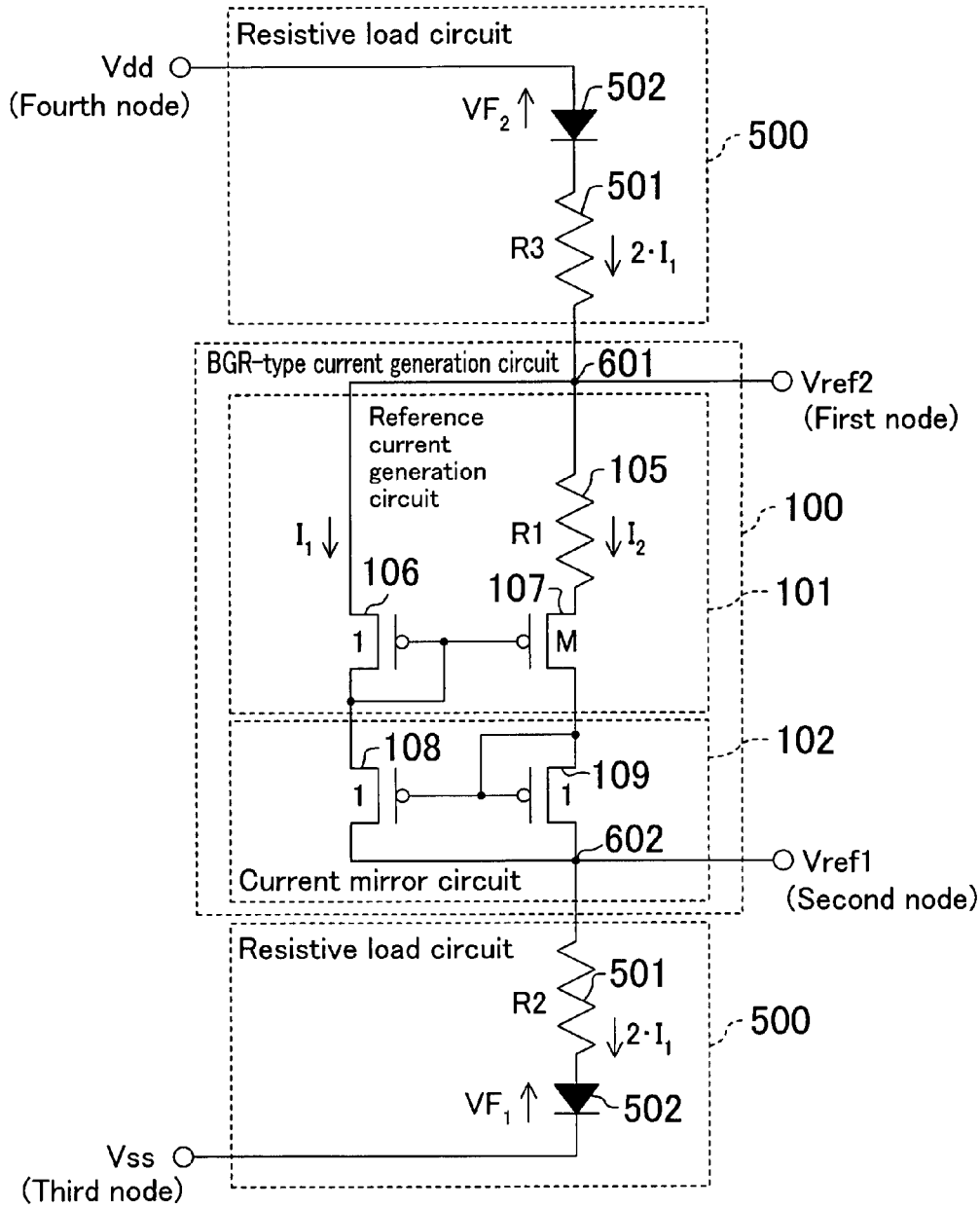
FIG. 14 is a circuit diagram showing a detailed circuit configuration of a reference voltage generation circuit according to Embodiment 6.

FIG. 14 is a circuit diagram showing a detailed circuit configuration of a reference voltage generation circuit according to Embodiment 6 of the present invention.

Referring to FIG. 14, the reference voltage generation circuit of the present embodiment is of a configuration in which the resistive load circuit 500, the BGR-type current generation circuit 100 and the resistive load circuit 500 are connected together in series between the fourth node and the third node. In the present embodiment, the fourth node is connected to the drain-side power supply, and the third node is connected to the source-side power supply.

The reference voltage generation circuit of the present embodiment outputs the voltage at a node 602 as the output voltage Vref1 and the voltage at a node 601 as the output voltage Vref2.

How the resistance value R1 of the resistive element 105, the resistance value R2 of the resistive element 501 of the resistive load circuit 500 connected to the third node, the resistance value R3 of the resistive element 501 of the resistive load circuit 500 connected to the fourth node, and the value M in the transistor size ratio 1:M between the PMOS transistors 106 and 107 are determined will now be described. The anode-cathode voltage (forward voltage) of the diode 502 of the resistive load circuit 500 connected to the third node is denoted as VF1, and that of the diode 502 of the resistive load circuit 500 connected to the fourth node is denoted as VF2.

Below are expressions representing the temperature dependency of the output voltages Vref1 and Vref2. The method for deriving the current flowing through the two resistive load circuits 500 is similar to Expressions 1 to 5, etc., of Embodiment 1, and will not be further described below.

The output voltage Vref1 is expressed as shown in Expression 25 below.

$$V_{ref1} = \frac{R_2}{R_1}\frac{nkT}{q}2\ln M + V_{F1} \qquad \text{Exp. 25}$$

The output voltage Vref2 is expressed as shown in Expression 26 below.

$$V_{ref2} = V_{dd} - \left\{\frac{R_3}{R_1}\frac{nkT}{q}2\ln M + V_{F2}\right\} \qquad \text{Exp. 26}$$

In Expressions 25 and 26, n is a constant dictated by the process, which typically is little dependent on the temperature and takes a value of about 1.4, for example. In the expression, k denotes the Boltzmann constant, T the absolute temperature and q the charge of electron.

The right-hand side of Expression 25 and the portion in the braces of the right-hand side of Expression 26 are of the same pattern as the right-hand side of Expression 6. By setting the ratio between R1 and R2 so that the right-hand side of Expression 25 is zero, there is obtained the temperature-independent output voltage Vref1, which is based on the source-side power supply potential Vss. By setting the ratio between R1 and R3 so that the portion in the braces of the right-hand side of Expression 26 is zero, there is obtained the temperature-independent output voltage Vref2, which is based on the drain-side power supply potential Vdd.

Thus, with the reference voltage generation circuit of the present embodiment shown in FIG. 14, it is possible to obtain two temperature-independent constant reference voltages, i.e., the output voltage Vref1 and the output voltage Vref2, as in the case shown in FIG. 11, etc. The output voltage Vref1 is a voltage based on the drain-side power supply potential Vss, and the output voltage Vref2 is based on the drain-side power supply potential Vdd.

In the reference voltage generation circuit of the present embodiment, two current paths merge together in the BGR-type current generation circuit 100 and extend as a single current path into the two resistive load circuits. Therefore, the current consumption can be reduced more easily as compared with a case where the currents flowing through the two current paths are mirrored by the current mirror circuit and a current mirrored from the currents flows into a resistive load circuit formed along another current path. Moreover, the total circuit area is reduced because it is not necessary to provide elements for mirroring. Thus, with the reference voltage generation circuit of the present embodiment, it is easy to generate a plurality of reference voltages with a small current consumption and a small circuit area.

In the present embodiment, the resistive load circuit 500 is used as each of the first and second resistive load circuits of FIG. 13, and the BGR-type current generation circuit 100 is used as the BGR-type current generation circuit. In other embodiments, resistive load circuits and BGR-type current generation circuits of other configurations may be used. For example, the resistive load circuit 103 of Embodiment 1 may be used as the second resistive load circuit, and the BGR-type current generation circuit 300 may be used as the BGR-type current generation circuit.

Embodiment 7

Figure 15:
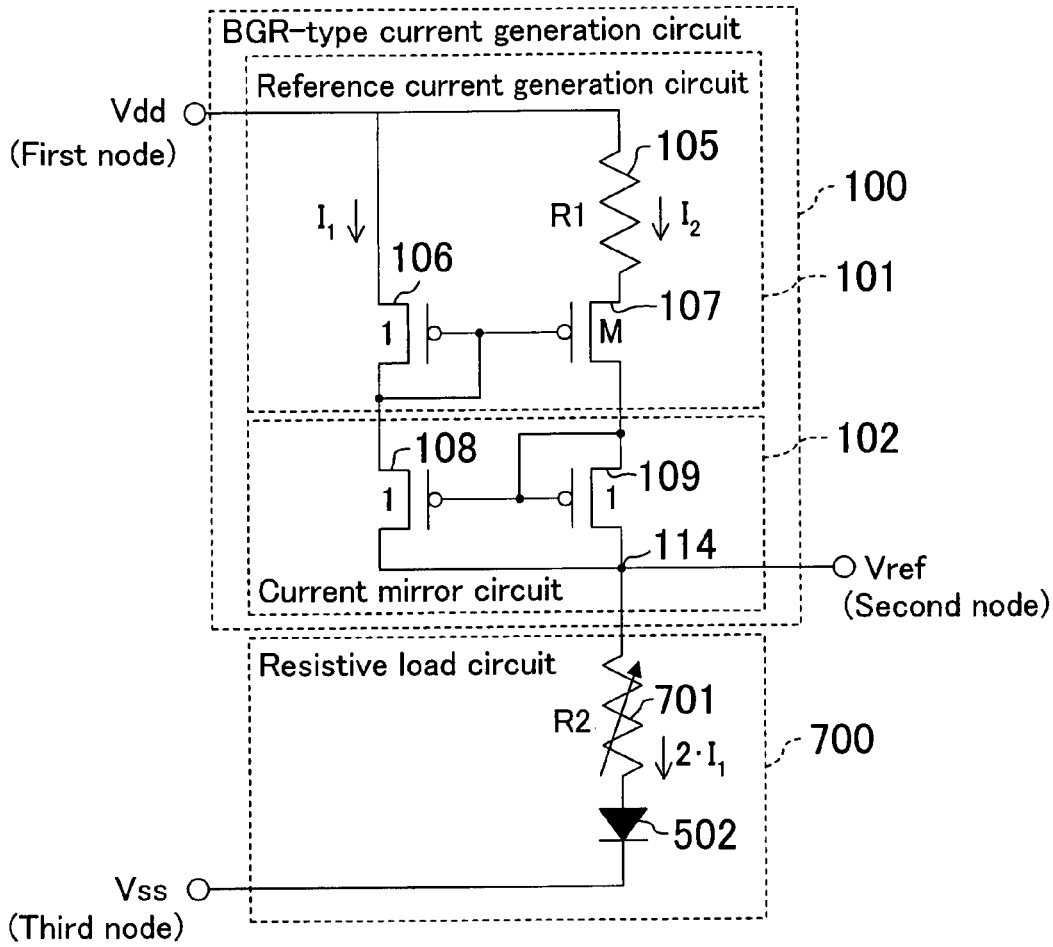
FIG. 15 is a circuit diagram showing a configuration of a reference voltage generation circuit according to Embodiment 7.

FIG. 15 is a circuit diagram showing a configuration of a reference voltage generation circuit according to Embodiment 7 of the present invention.

The reference voltage generation circuit of FIG. 15 includes the BGR-type current generation circuit 100 and a resistive load circuit 700. The resistive load circuit 700 differs from the resistive load circuit 500 of Embodiment 5 in that a resistive element 701 whose resistance value can be adjusted is used instead of the resistive element 501.

The resistance value of the resistive element 701 can be adjusted by means of a laser trimming or anti-fusing process performed after circuit patterns are made in a wafer.

Where the anode-cathode voltage (forward voltage) of the diode 502 is denoted as VF1, Vref can be expressed as shown in Expression 27 below, i.e., with the same expression as that for Vref1 of Embodiment 6.

$$V_{ref} = \frac{R_2}{R_1}\frac{nkT}{q}2\ln M + V_{F1} \quad \text{Exp. 27}$$

With the reference voltage generation circuit of the present embodiment, the resistance value of the resistive element 701 can be variably controlled. Therefore, if the forward voltage of the diode 502 is varied due to the process conditions, the output voltage Vref as shown in Expression 27 can be adjusted by controlling the resistance value of the resistive element 701.

Variation of Embodiment 7

Even with resistive load circuits other than the resistive load circuit 700, a resistive element whose resistance value can be adjusted can be used.

Figure 16:
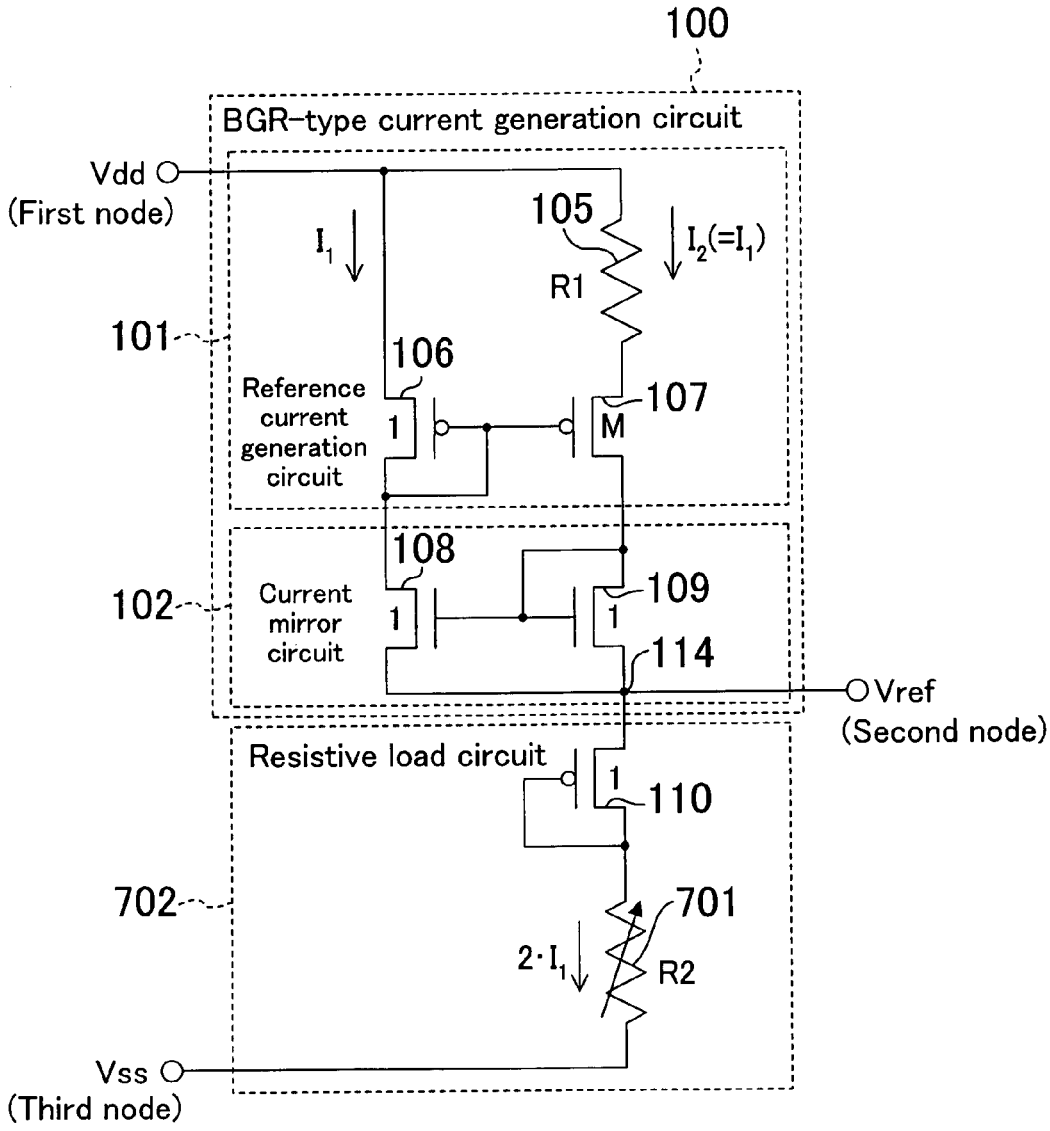
FIG. 16 is a circuit diagram showing a configuration of a reference voltage generation circuit according to a variation of Embodiment 7.

For example, a resistive load circuit 702 of the reference voltage generation circuit shown in FIG. 16 includes the resistive element 701 whose resistance value can be adjusted, instead of the resistive element 111 of the resistive load circuit 103 described above in Embodiment 1.

Vref is expressed by Expression 6 described above in Embodiment 1.

With the reference voltage generation circuit of FIG. 16, the output voltage Vref expressed by Expression 6 can be adjusted by controlling the resistance value of the resistive element 701 when the threshold voltage of the PMOS transistor 110 is varied due to the process conditions.

Embodiment 8

The reference voltage generation circuits of Embodiments 1 to 7 intrinsically have a bistability problem. A bistability problem is a problem that there is an abnormal stable state in addition to a normal stable state, and once the reference voltage generation circuit enters the abnormal stable state it will not return to the normal stable state. The normal stable state is a state where a current flows through the reference voltage generation circuit as described above in Embodiments 1 to 7 to normally generate the output voltage Vref. The abnormal stable state is a state where the gate voltage of the transistor of the BGR-type current generation circuit becomes stable at such a level that no current flows through the transistor. For example, the abnormal state is a state where the gate voltage of the PMOS transistors 106 and 107 of FIG. 1 is being the potential Vdd and that of the NMOS transistors 108 and 109 is being the potential Vss.

A reference voltage generation circuit including a circuit for eliminating the bistability problem will now be described as a reference voltage generation circuit of Embodiment 8.

Figure 17:
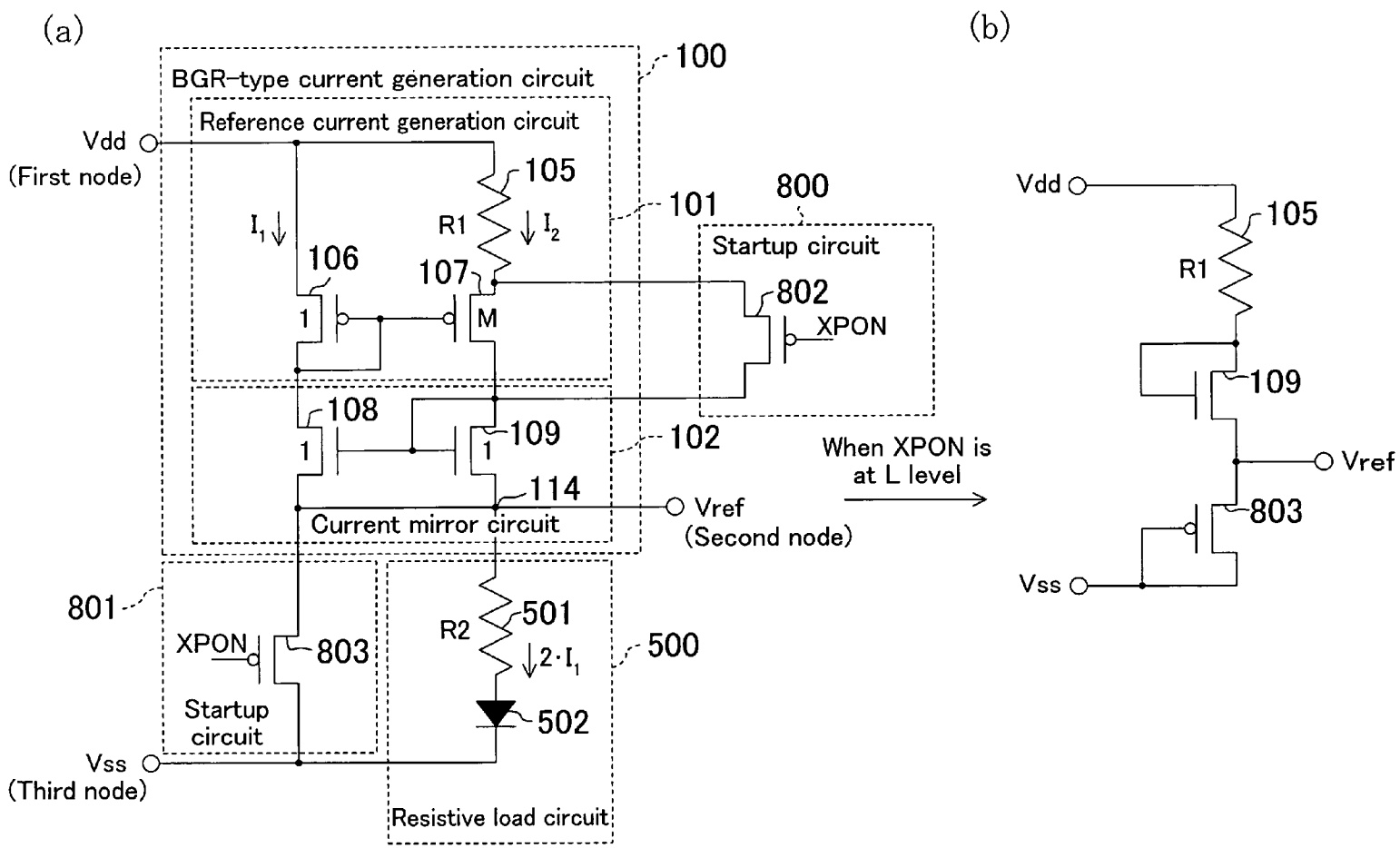
FIG. 17 is a circuit diagram showing a configuration of a reference voltage generation circuit according to Embodiment 8.

FIG. 17 is a circuit diagram showing a configuration of a reference voltage generation circuit according to Embodiment 8 of the present invention.

Referring to FIG. 17, the reference voltage generation circuit of the present embodiment includes a startup circuit 800 including a PMOS transistor 802 and a startup circuit 801 including a PMOS transistor 803, in addition to the BGR-type current generation circuit 100 and the resistive load circuit 500.

The PMOS transistor 802 and the PMOS transistor 803 are turned ON by bringing a power-ON control signal XPON to the L level (the potential Vss). Thus, the PMOS transistor 802 and the PMOS transistor 803 can each serve as a switch.

The present embodiment is directed to a case where an initialization pulse that temporarily goes to the L level (the potential Vss) is input as the power-ON control signal XPON at the startup.

When the power-ON control signal XPON goes to the L level, the PMOS transistor 802 is turned ON, the source and the drain of the PMOS transistor 107 are shorted together, the gate voltage of the NMOS transistors 108 and 109 increases, and the gate voltage of the PMOS transistors 106 and 107 decreases. Therefore, even if the reference voltage generation circuit happens to be in an abnormal stable state where the gate voltage of the PMOS transistors 106 and 107 is the potential Vdd and the gate voltage of the NMOS transistors 108 and 109 is the potential Vss before the startup, the reference voltage generation circuit can be transitioned from the abnormal stable state to the normal stable state by bringing the power-ON control signal XPON to the L level at the startup.

The transition of the reference voltage generation circuit to the normal stable state can be made without the startup circuit 801 as long as the startup circuit 800 is provided. Without the startup circuit 801, however, the output voltage Vref output to the node 114 is substantially dependent on the potential Vdd.

In the present embodiment, where the startup circuit 801 is provided, the output voltage Vref at the startup is a voltage according to (controlled by) the gate-source voltage of the PMOS transistor 803 by turning ON the PMOS transistor 803 by bringing the power-ON control signal XPON to the L level. Therefore, by appropriately determining the transistor size of the PMOS transistor 803, it is possible to reduce the difference between the output voltage Vref at the startup and that during a normal operation. The circuit (b) in FIG. 17 is an equivalent circuit to the circuit (a) where the power-ON control signal XPON at the L level is input at the startup.

The present embodiment may employ, as a switch, an NMOS transistor receiving at its gate a signal reversed from (complementary to) the power-ON control signal XPON, instead of the PMOS transistor 802.

Figure 18:
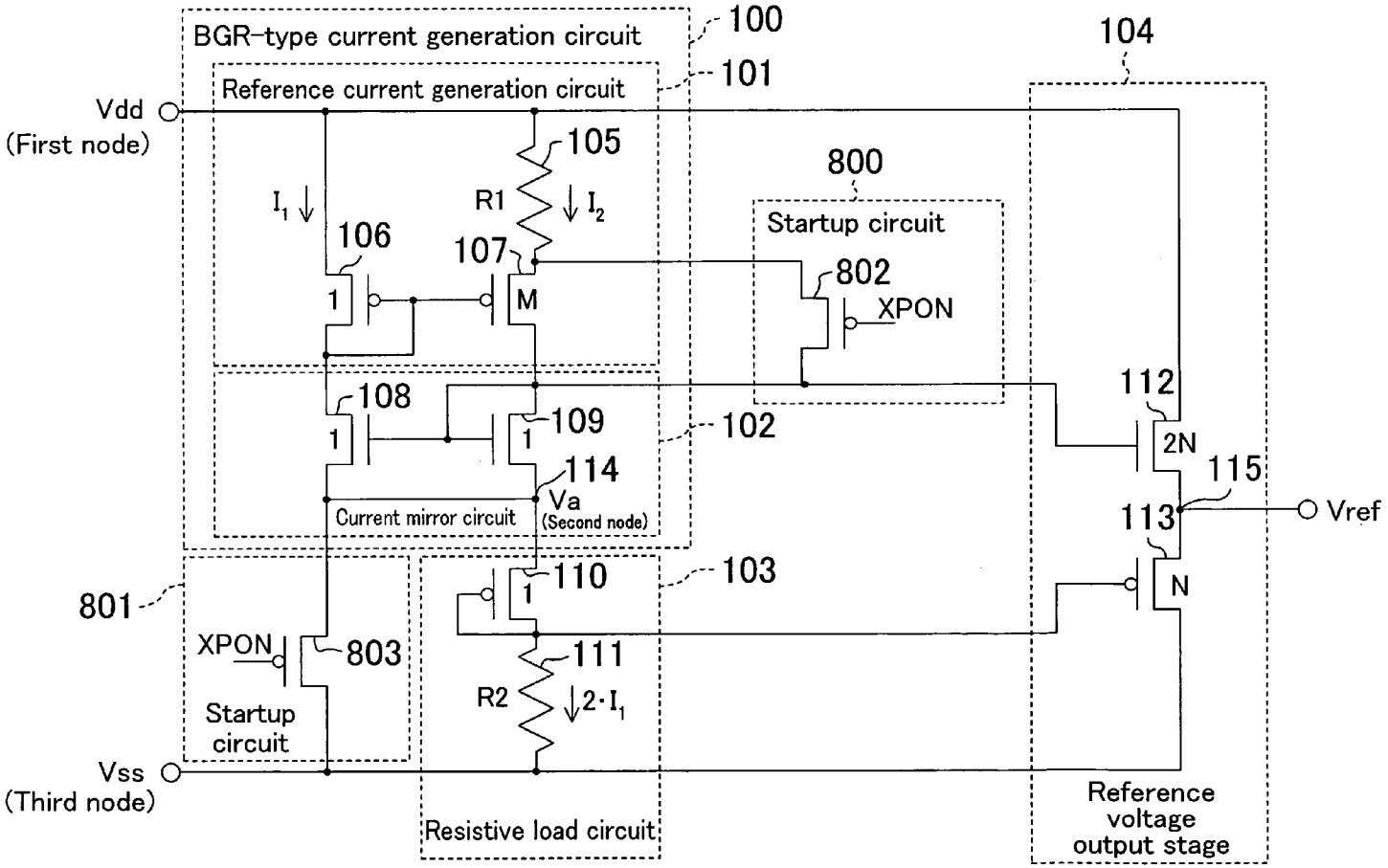
FIG. 18 is a circuit diagram showing a circuit configuration where startup circuits 800 and 801 are provided in the reference voltage generation circuit of Embodiment 1.

The startup circuits 800 and 801 may be provided in the reference voltage generation circuit of Embodiment 1, in which case the circuit takes a configuration as shown in FIG. 18.

The startup circuits 800 and 801 can be provided in the reference voltage generation circuits of Embodiments 2 to 7. The startup circuit 800 may be provided so that the transistor of the startup circuit 800 connects together the drain and the source of a first one of a pair of transistors provided in the reference current generation circuit and a pair of transistors provided in the current mirror circuit, wherein the drain of the first transistor is connected to the gate of a second one of the pairs of transistors, the second transistor being on the lower potential-side with respect to the first transistor. The startup circuit 801 can be provided so that the transistor of the startup circuit 801 controls the connection between the power supply to which the resistive load circuit is connected and the node 114, i.e., the connection between the second node and the third node (or the connection between the first node and the fourth node) in FIGS. 9, 10 and 13. Also in such a case, similar effects to those described above can be realized with operation principles similar to those described above.

Alternative Embodiments

The reference voltage generation circuit obtained by removing the reference voltage output stage 104 from the reference voltage generation circuits of FIGS. 1 to 8 and the reference voltage generation circuit where the reference voltage output stage 104 is not provided such as those of Embodiments 5 and 6 may employ either a resistive load circuit where a resistive element and a diode are connected in series with each other or a resistive load circuit where a resistor and a MOS transistor are connected in series with each other. The MOS transistor used in the resistive load circuit is not limited to a PMOS transistor whose drain and gate are connected together (the diode connection), but may be an NMOS transistor whose drain and gate are connected together (the diode connection). The elements forming the resistive load circuit are not limited to those mentioned in the embodiments above, e.g., resistive elements and diodes. The resistive load circuit may employ those elements in which a voltage thereacross is in proportion to the current therethrough with a positive proportionality constant, and those elements in which a voltage thereacross is in proportion to the absolute temperature with a negative proportionality constant.

Alternatively, the resistive load circuit may employ either those elements in which a voltage thereacross is in proportion to the current therethrough with a positive proportionality constant, or those elements in which a voltage thereacross is in proportion to the absolute temperature with a negative proportionality constant. In such a case, however, the output voltage Vdd is dependent on the temperature. For example, if the resistive load circuit only includes a resistive element, the output voltage Vref will be lower, by the forward voltage of a diode, than that in a case where the resistive load circuit includes a resistive element and a diode, and the output voltage Vref will have a positive temperature coefficient.

In the reference voltage generation circuits of Embodiments 1 to 6 and 8 and variations thereof, the resistive element in the resistive load circuit may be replaced by a resistive element of Embodiment 7 whose resistance value can be adjusted.

The reference voltage generation circuit of the present invention is capable of generating a high-precision, stable voltage with a small current consumption and a small area, and is thus suitable as a band gap reference-type reference voltage generation circuit, or the like, for use in portable systems, battery-powered systems, integrated circuits provided therein, etc.

What is claimed is:

1. A reference voltage generation circuit, comprising:

a current mirror circuit including a first current mirror MOS transistor provided along a first current path extending from a first node to a second node, and a second current mirror MOS transistor for conducting, through a second current path extending from the first node to the second node, a current being a multiple of that flowing through the first current path; and a reference current generation circuit including a first reference current MOS transistor or a first reference current diode provided along the first current path and a second reference current MOS transistor or a second reference current diode provided along the second current path, whereby each of currents flowing through the first and second current paths is a constant reference current according to a gate-source voltage difference occurring in the first and second reference current MOS transistors or an anode-cathode voltage difference occurring in the first and second reference current diodes, wherein:

a source of at least one of the first and second current mirror MOS transistors and the first and second reference current MOS transistors is connected to the second node;

a resistive load circuit including a load section MOS transistor whose source is connected to the second node and whose gate and drain are connected to each other, and a resistive element connected between the drain of the load section MOS transistor and a third node; and a reference voltage output stage for outputting a voltage at an output node as a reference voltage, including a first output stage MOS transistor and a second output stage MOS transistor, wherein the first output stage MOS transistor has a drain connected to the first node, a source connected to the output node, and a gate connected to the gate of the MOS transistor whose source is connected to the second node, and the second output stage MOS transistor has a source connected to the output node, a drain connected to the third node, and a gate connected to the gate of the load section MOS transistor.

2. The reference voltage generation circuit of claim 1, wherein:

the reference current generation circuit further includes a resistive element a first end of which is connected to a first one of the first and second nodes;

the first reference current MOS transistor is a transistor whose source is connected to a second end of the resistive element;

the second reference current MOS transistor is a transistor whose source is connected to the first one of the first and second nodes and whose gate and drain are connected to each other and to a gate of the first reference current MOS transistor;

the first current mirror MOS transistor is a transistor whose drain and gate are connected to each other, to a drain of the first reference current MOS transistor and to a gate of the second current mirror MOS transistor, and whose source is connected to a second one of the first and second nodes;

the second current mirror MOS transistor is a transistor whose drain is connected to the drain of the second reference current MOS transistor, and whose source is connected to the second one of the first and second nodes; and the first one of the first and second nodes is of a higher potential than the second one of the first and second nodes;

the first and second reference current MOS transistors are each a PMOS transistor;

the first and second current mirror MOS transistors are each an NMOS transistor; or the first one of the first and second nodes is of a lower potential than the second one of the first and second nodes;

the first and second reference current MOS transistors are each an NMOS transistor; and the first and second current mirror MOS transistors are each a PMOS transistor.

3. The reference voltage generation circuit of claim 2, wherein:

the first node is of a higher potential than the third node;

the load section MOS transistor is a PMOS transistor;

the first output stage MOS transistor is an NMOS transistor; and the second output stage MOS transistor is a PMOS transistor; or the first node is of a lower potential than the third node;

the load section MOS transistor is an NMOS transistor;

the first output stage MOS transistor is a PMOS transistor; and the second output stage MOS transistor is an NMOS transistor.

4. The reference voltage generation circuit of claim 2, further comprising at least one of a pair of MOS transistors, which together with the first and second reference current MOS transistors form a cascode current mirror structure, and a pair of MOS transistors, which together with the first and second current mirror MOS transistors form a cascode current mirror structure.

5. The reference voltage generation circuit of claim 4, wherein at least one of the first current path and the second current path is provided with a resistive element, wherein a first, higher potential-side end of the resistive element is connected to a common gate of a higher potential-side one of the two pairs of MOS transistors together forming the cascode current mirror structure, and a second end of the resistive element is connected to a common gate of a lower potential-side one of the two pairs of MOS transistors.

6. The reference voltage generation circuit of claim 2, further comprising a MOS transistor for connecting together the drain and the source of a first one of the first and second reference current MOS transistors and the first and second current mirror MOS transistors, wherein the drain of the first transistor is connected to the gate of a second one of the pairs of transistors, the second transistor being on a lower potential-side with respect to the first transistor.

7. The reference voltage generation circuit of claim 6, further comprising a MOS transistor for connecting together the second node and the third node.

8. The reference voltage generation circuit of claim 1, wherein:

the reference current generation circuit further includes a resistive element connected in series with the first reference current diode to form a resistor diode series circuit, and first and second virtual short MOS transistors;

a first end of the resistor diode series circuit is connected to the first node, and a second end thereof is connected to a source of the first virtual short MOS transistor;

a first end of the second reference current diode is connected to the first node, and a second end thereof is connected to a source of the second virtual short MOS transistor;

a gate and a drain of the second virtual short MOS transistor are connected to each other, to a gate of the first virtual short MOS transistor, and to the drain of the second current mirror MOS transistor;

the gate and the drain of the first current mirror MOS transistor are connected to each other, to a drain of the first virtual short MOS transistor, and to the gate of the second current mirror MOS transistor, and the source of the first current mirror MOS transistor is connected to the second node;

the source of the second current mirror MOS transistor is connected to the second node; and the first node is of a higher potential than the second node;

the first and second virtual short MOS transistors are each a PMOS transistor;

the first and second current mirror MOS transistors are each an NMOS transistor;

the load section MOS transistor is a PMOS transistor;

the first output stage MOS transistor is an NMOS transistor;

the second output stage MOS transistor is a PMOS transistor;

the first end of the resistor diode series circuit is an anode of the first reference current diode or an end thereof connected to the anode via the resistive element therebetween; and the first end of the second reference current diode is an anode; or the first node is of a lower potential than the second node;

the first and second virtual short MOS transistors are each an NMOS transistor;

the first and second current mirror MOS transistors are each a PMOS transistor;

the load section MOS transistor is an NMOS transistor;

the first output stage MOS transistor is a PMOS transistor;

the second output stage MOS transistor is an NMOS transistor;

the first end of the resistor diode series circuit is a cathode of the first reference current diode or an end thereof connected to the cathode via the resistive element therebetween; and the first end of the second reference current diode is a cathode.

9. The reference voltage generation circuit of claim 8, further comprising at least one of a pair of MOS transistors, which together with the first and second virtual short MOS transistors form a cascode current mirror structure, and a pair of MOS transistors, which together with the first and second current mirror MOS transistors form a cascode current mirror structure.

10. The reference voltage generation circuit of claim 9, wherein at least one of the first current path and the second current path is provided with a resistive element, wherein a first, higher potential-side end of the resistive element is connected to a common gate of a higher potential-side one of the two pairs of MOS transistors together forming the cascode current mirror structure, and a second end of the resistive element is connected to a common gate of a lower potential-side one of the two pairs of MOS transistors.

11. The reference voltage generation circuit of claim 8, further comprising a MOS transistor for connecting together the drain and the source of a first one of the first and second virtual short MOS transistors and the first and second current mirror MOS transistors, wherein the drain of the first transistor is connected to the gate of a second one of the pairs of transistors, the second transistor being on a lower potential-side with respect to the first transistor.

12. The reference voltage generation circuit of claim 11, further comprising a MOS transistor for connecting together the second node and the third node.

13. The reference voltage generation circuit of claim 1, wherein a resistance value of the resistive element of the resistive load circuit can be adjusted.

14. The reference voltage generation circuit of claim 1, wherein:

the first node is connected to a first power supply; and the third node is connected to a second power supply.

15. A reference voltage generation circuit, comprising:

a band gap reference-type current generation circuit for controlling each of currents flowing through a first current path and a second current path, which are extending from a first node to a second node, to be a predetermined reference current, by utilizing a voltage difference occurring between a pair of transistors or diodes;

a first resistive load circuit provided between the second node and a third node; and a second resistive load circuit provided between the first node and a fourth node.

16. The reference voltage generation circuit of claim 15, wherein:

the fourth node is connected to a first power supply;

the third node is connected to a second power supply.

17. A reference voltage generation circuit, comprising:

a band gap reference-type current generation circuit for controlling each of currents flowing through a first current path and a second current path, which are extending from a first node to a second node, to be a predetermined reference current, by utilizing a voltage difference occurring between a pair of transistors or diodes; and a resistive load circuit provided between the second node and a third node, wherein the band gap reference-type current generation circuit includes:

a current mirror circuit including a first current mirror MOS transistor provided along the first current path, and a second current mirror MOS transistor for conducting, through the second current path, a current being a multiple of that flowing through the first current path; and a reference current generation circuit including a first reference current MOS transistor or a first reference current diode provided along the first current path, and a second reference current MOS transistor or a second reference current diode provided along the second current path, for controlling each of currents flowing through the first and second current paths to be a constant reference current according to a gate-source voltage difference occurring in the first and second reference current MOS transistors or an anode-cathode voltage difference occurring in the first and second reference current diodes.

18. The reference voltage generation circuit of claim 17, wherein:

the reference current generation circuit further includes a resistive element a first end of which is connected to a first one of the first and second nodes;

the first reference current MOS transistor is a transistor whose source is connected to a second end of the resistive element;

the second reference current MOS transistor is a transistor whose source is connected to the first one of the first and second nodes and whose gate and drain are connected to each other and to a gate of the first reference current MOS transistor;

the first current mirror MOS transistor is a transistor whose drain and gate are connected to each other, to a drain of the first reference current MOS transistor and to a gate of the second current mirror MOS transistor, and whose source is connected to a second one of the first and second nodes;

the second current mirror MOS transistor is a transistor whose drain is connected to the drain of the second reference current MOS transistor, and whose source is connected to the second one of the first and second nodes; and the first one of the first and second nodes is of a higher potential than the second one of the first and second nodes;

the first and second reference current MOS transistors are each a PMOS transistor;

the first and second current mirror MOS transistors are each an NMOS transistor; or the first one of the first and second nodes is of a lower potential than the second one of the first and second nodes;

the first and second reference current MOS transistors are each an NMOS transistor; and the first and second current mirror MOS transistors are each a PMOS transistor.

19. The reference voltage generation circuit of claim 18, further comprising at least one of a pair of MOS transistors, which together with the first and second reference current MOS transistors form a cascode current mirror structure, and a pair of MOS transistors, which together with the first and second current mirror MOS transistors form a cascode current mirror structure.

20. The reference voltage generation circuit of claim 19, wherein at least one of the first current path and the second current path is provided with a resistive element, wherein a first, higher potential-side end of the resistive element is connected to a common gate of a higher potential-side one of two pairs of MOS transistors together forming the cascode current mirror structure, and a second end of the resistive element is connected to a common gate of a lower potential-side one of the two pairs of MOS transistors.

21. The reference voltage generation circuit of claim 18, further comprising a MOS transistor for connecting together the drain and the source of a first one of the first and second reference current MOS transistors and the first and second current mirror MOS transistors, wherein the drain of the first transistor is connected to the gate of a second one of the pairs of transistors, the second transistor being on a lower potential-side with respect to the first transistor.

22. The reference voltage generation circuit of claim 21, further comprising a MOS transistor for connecting together the second node and the third node.

23. The reference voltage generation circuit of claim 17, wherein:

the reference current generation circuit further includes a resistive element connected in series with the first reference current diode to form a resistor diode series circuit, and first and second virtual short MOS transistors;

a first end of the resistor diode series circuit is connected to a first one of the first node and the second node, and a second end thereof is connected to a source of the first virtual short MOS transistor;

a first end of the second reference current diode is connected to the first one of the first node and the second node, and a second end thereof is connected to a source of the second virtual short MOS transistor;

a gate and a drain of the second virtual short MOS transistor are connected to each other, to a gate of the first virtual short MOS transistor, and to the drain of the second current mirror MOS transistor;

the gate and the drain of the first current mirror MOS transistor are connected to each other, to a drain of the first virtual short MOS transistor, and to the gate of the second current mirror MOS transistor, and the source of the first current mirror MOS transistor is connected to a second one of the first node and the second node;

the source of the second current mirror MOS transistor is connected to the second one of the first node and the second node; and the first one of the first node and the second node is of a higher potential than the second one of the first node and the second node;

the first and second virtual short MOS transistors are each a PMOS transistor;

the first and second current mirror MOS transistors are each an NMOS transistor;

the first end of the resistor diode series circuit is an anode of the first reference current diode or an end thereof connected to the anode via the resistive element therebetween; and the first end of the second reference current diode is an anode; or the first one of the first node and the second node is of a lower potential than the second one of the first node and the second node;

the first and second virtual short MOS transistors are each an NMOS transistor;

the first and second current mirror MOS transistors are each a PMOS transistor;

the first end of the resistor diode series circuit is a cathode of the first reference current diode or an end thereof connected to the cathode via the resistive element therebetween; and the first end of the second reference current diode is a cathode.

24. The reference voltage generation circuit of claim 23, further comprising at least one of a pair of MOS transistors, which together with the first and second virtual short MOS transistors form a cascode current mirror structure, and a pair of MOS transistors, which together with the first and second current mirror MOS transistors form a cascode current mirror structure.

25. The reference voltage generation circuit of claim 24, wherein at least one of the first current path and the second current path is provided with a resistive element, wherein a first, higher potential-side end of the resistive element is connected to a common gate of a higher potential-side one of the two pairs of MOS transistors together forming the cascode current mirror structure, and a second end of the resistive element is connected to a common gate of a lower potential-side one of the two pairs of MOS transistors.

26. The reference voltage generation circuit of claim 23, further comprising a MOS transistor for connecting together the drain and the source of a first one of the first and second virtual short MOS transistors and the first and second current mirror MOS transistors, wherein the drain of the first transistor is connected to the gate of a second one of the pairs of transistors, the second transistor being on a lower potential-side with respect to the first transistor.

27. The reference voltage generation circuit of claim 26, further comprising a MOS transistor for connecting together the second node and the third node.

28. A reference voltage generation circuit, comprising:

a band gap reference-type current generation circuit for controlling each of currents flowing through a first current path and a second current path, which are extending from a first node to a second node, to be a predetermined reference current, by utilizing a voltage difference occurring between a pair of transistors or diodes; and a resistive load circuit provided between the second node and a third node, wherein the resistive load circuit provided between the second node and the third node includes an element in which a voltage thereacross is in proportion to a current therethrough with a positive proportionality constant, and an element in which a voltage thereacross is in proportion to an absolute temperature with a negative proportionality constant.

29. The reference voltage generation circuit of claim 28, wherein the resistive load circuit, including the element in which a voltage thereacross is in proportion to a current therethrough with a positive proportionality constant and the element in which a voltage thereacross is in proportion to an absolute temperature with a negative proportionality constant, is formed by a resistive element and a diode connected in series with each other.

30. The reference voltage generation circuit of claim 29, wherein a resistance value of the resistive element of the resistive load circuit can be adjusted.

31. The reference voltage generation circuit of claim 28, wherein the resistive load circuit, including the element in which a voltage thereacross is in proportion to a current therethrough with a positive proportionality constant and the element in which a voltage thereacross is in proportion to an absolute temperature with a negative proportionality constant, is formed by a MOS transistor and a resistive element connected in series with each other, in which a gate and a drain of the MOS transistor are connected to each other.

32. The reference voltage generation circuit of claim 31, wherein a resistance value of the resistive element of the resistive load circuit can be adjusted.

* * * * *